US005275930A

United States Patent [19]

Maskasky

[11] Patent Number: 5,275,930

[45] Date of Patent: Jan. 4, 1994

[54] HIGH TABULARITY HIGH CHLORIDE EMULSIONS OF EXCEPTIONAL STABILITY

[75] Inventor: Joe E. Maskasky, Rochester, N.Y.

[73] Assignee: Eastman Kodak Company, Rochester, N.Y.

[21] Appl. No.: 935,949

[22] Filed: Aug. 27, 1992

[51] Int. Cl.[5] ..... G03C 1/015; G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,063,951 | 12/1977 | Bogg | 430/567 |
| 4,386,156 | 5/1983 | Mignot | 430/567 |
| 4,399,215 | 8/1983 | Wey | 430/567 |
| 4,400,463 | 8/1983 | Maskasky | 430/567 |
| 4,414,306 | 11/1983 | Wey et al. | 430/567 |
| 4,435,501 | 3/1984 | Maskasy | 430/567 |
| 4,713,323 | 12/1987 | Maskasky | 430/567 |
| 4,786,588 | 11/1988 | Ogawa | 430/567 |
| 4,791,053 | 12/1988 | Ogawa et al. | 430/567 |
| 4,804,621 | 2/1989 | Tufano | 430/567 |
| 4,820,624 | 4/1989 | Hasebe et al. | 430/567 |
| 4,865,962 | 9/1989 | Hasebe et al. | 430/567 |
| 4,942,120 | 7/1990 | King et al. | 430/567 |
| 4,983,508 | 1/1991 | Ishiguro | 430/567 |
| 5,035,992 | 7/1991 | Houle et al. | 430/567 |

FOREIGN PATENT DOCUMENTS

| | | |
|---|---|---|
| 252649 | 11/1991 | Japan . |
| 288143 | 12/1991 | Japan . |

OTHER PUBLICATIONS

Endo and Okaji, "An Empirical Rule to Modify the Habit of Silver Chloride to Form Tabular Grains in an Emulsion", *The Journal of Photographic Science*, vol. 36, pp. 182–188, 1988.

Mumaw and Haugh, "Silver Halide Precipitation Coalescence Processes", *Journal of Imaging Science*, vol. 30, No. 5, Sep./Oct. 1986, pp. 198–299.

Symposium: Torino 1963, *Photographic Science*, Edited by C. Semerano and U. Mazzucato, Focal Press 52–55.

Sugimoto and Miyake, "Mechanism of Halide Conversion Process of Colloidal AgCl Microcrystals by Br⁻Ions", Parts I and II, *Journal of Colloid and Interface Science*, vol. 140, No. 2 Dec. 1990, pp. 335–361.

*Primary Examiner*—Janet C. Baxter

*Attorney, Agent, or Firm*—Carl O. Thomas

[57] ABSTRACT

A chemically sensitized high chloride tabular grain emulsion is disclosed. The tabular grains have {100} major faces. Chemically sensitized silver halide epitaxial deposits containing less than 75 percent of the chloride ion concentration of the tabular grains and accounting for less than 20 mole percent of total silver are located at one or more of the corners of the tabular grains.

The emulsions are prepared by first forming the host tabular grains, epitaxially depositing silver halide selected to contain less than 50 percent of the chloride ion concentration of the tabular grains, adsorbing a photographically useful compound to the surfaces of the silver halide epitaxial deposits, and chemically digesting the emulsion.

18 Claims, 8 Drawing Sheets 1.0 μm 1.0 μm 1.0 μm 1.0 μm 1.0 μm 1.0 μm 2.0 μm 2.0 μm 2.0 μm

HIGH TABULARITY HIGH CHLORIDE EMULSIONS OF EXCEPTIONAL STABILITY

FIELD OF THE INVENTION

The invention relates to silver halide photography. More specifically, the invention relates to radiation sensitive silver halide emulsions useful in photography.

BACKGROUND OF THE INVENTION

Radiation sensitive silver halide emulsions containing one or a combination of chloride, bromide and iodide ions have been long recognized to be useful in photography. Each halide ion selection is known to impart particular photographic advantages. By a wide margin the most commonly employed photographic emulsions are silver bromide and bromoiodide emulsions. Although known and used for many years for selected photographic applications, the more rapid developability and the ecological advantages of high chloride emulsions have provided an impetus for employing these emulsions over a broader range of photographic applications. As employed herein the term "high chloride emulsion" refers to a silver halide emulsion containing at least 50 mole percent chloride, based on total silver. The most ecologically attractive high chloride emulsions are those that contain no iodide ion or very low levels of iodide ion.

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multiemulsion layer formats, can be realized by increasing the proportions of selected tabular grain populations in photographic emulsions.

Although varied definitions have been adopted in defining tabular grain emulsions, there is a general consensus that the functionally significant distinguishing feature of tabular grains lies in the large disparity between tabular grain equivalent circular diameter (ECD, the diameter of a circle having an area equal to the projected area of the tabular grain) and tabular grain thickness (t, the dimension of the tabular grain normal to its opposed parallel major faces). Average tabular grain aspect ratio (ECD/t) and tabularity ($ECD/t^2$, where ECD and t are each measured in μm) are art accepted quantifiers of this disparity. To distinguish tabular grain emulsions from those that contain only incidental tabular grain inclusions it is also the recognized practice of the art to require that a significant percentage (e.g., greater than 30 percent and more typically greater than 50 percent) of total grain projected area be accounted for by tabular grains.

An emulsion is generally understood to be a "high aspect ratio tabular grain emulsion" when tabular grains having a thickness of less than 0.3 μm have an average aspect ratio of greater than 8 and account for greater than 50 percent of total grain projected area. The difficulty in achieving high average aspect ratios in high chloride tabular grain emulsions has often led to accepting average aspect ratios of greater than 5 as the best available approximations of high average aspect ratios. The term "thin tabular grain" is generally understood to be a tabular grain having a thickness of less than 0.2 μm. The term "ultrathin tabular grain" is generally understood to be a tabular grain having a thickness of 0.06 μm or less. High chloride thin tabular grain emulsions have been difficult to prepare and ultrathin high chloride tabular grain emulsions have been completely unknown.

In almost every instance tabular grain emulsions satisfying grain thickness (t), average aspect ratio (ECD/t), average tabularity ($ECD/t^2$) and projected area aims have been formed by introducing two or more parallel twin planes into octahedral grains during their preparation. Regular octahedral grains are bounded by {111} crystal faces. The predominant feature of tabular grains formed by twinning are opposed parallel {111} major crystal faces. The major crystal faces have a three fold symmetry, typically appearing triangular or hexagonal.

(a) Tabular Grains

The formation of tabular grain emulsions containing parallel twin planes is most easily accomplished in the preparation of silver bromide emulsions. The art has developed the capability of including photographically useful levels of iodide. The inclusion of high levels of chloride as opposed to bromide, alone or in combination with iodide, has been difficult. Silver chloride differs from silver bromide in exhibiting a much stronger propensity toward the formation of grains with faces lying in {100} crystallographic planes. Unfortunately, twinning of grains bounded by {100} crystal faces does not produce grains having a tabular shape. To produce successfully a high chloride tabular grain emulsion by twinning, conditions must be found that favor both the formation of twin planes and {111} crystal faces. Further, after the emulsion has been formed, care in subsequent handling must be exercised to avoid reversion of the grains to their favored more stable form exhibiting {100} crystal faces.

Wey U.S. Pat. No. 4,399,215 produced the first silver chloride high aspect ratio ($ECD/t>8$) tabular grain emulsion. The tabular grains were of the twinned type, exhibiting major faces of three fold symmetry lying in {111} crystallographic planes. An ammoniacal double-jet precipitation technique was employed. The thicknesses of the tabular grains were high compared to contemporaneous silver bromide and bromoiodide tabular grain emulsions because the ammonia ripening agent thickened the tabular grains. To achieve ammonia ripening it was also necessary to precipitate the emulsions at a relatively high pH, which is known to produce elevated minimum densities (fog) in high chloride emulsions. Further, to avoid degrading the tabular grain geometries sought both bromide and iodide ions were excluded from the tabular grains early in their formation.

Wey et al U.S. Pat. No. 4,414,306 developed a twinning process for preparing silver chlorobromide emulsions containing up to 40 mole percent chloride based on total silver. This process of preparation has not been successfully extended to high chloride emulsions.

Maskasky U.S. Pat. No. 4,400,463 (hereinafter designated Maskasky I) developed a strategy for preparing a high chloride emulsion containing tabular grains with parallel twin planes and {111} major crystal faces with the significant advantage of tolerating significant internal inclusions of the other halides. The strategy was to use a particularly selected synthetic polymeric peptizer in combination with a grain growth modifier having as its function to promote the formation of {111} crystal faces. Adsorbed aminoazaindenes, preferably adenine, and iodide ions were disclosed to be useful grain growth modifiers.

Maskasky U.S. Pat. No. 4,713,323 (hereinafter designated Maskasky II), significantly advanced the state of the art by preparing high chloride emulsions containing tabular grains with parallel twin planes and {111} major crystal faces using an aminoazaindene growth modifier and a gelatino-peptizer containing up to 30 micromoles per gram of methionine. Since the methionine content of a gelatino-peptizer, if objectionably high, can be readily reduced by treatment with a strong oxidizing agent (or alkylating agent, King et al U.S. Pat. No. 4,942,120), Maskasky II placed within reach of the art high chloride tabular grain emulsions with significant bromide and iodide ion inclusions prepared starting with conventional and universally available peptizers.

Maskasky I and II have stimulated further investigations of grain growth modifiers capable of preparing high chloride emulsions of similar tabular grain content. Tufano et al U.S. Pat. No. 4,804,621 employed di(hydroamino)azines as grain growth modifiers; Takada et al U.S. Pat. No. 4,783,398 employed heterocycles containing a divalent sulfur ring atom; Nishikawa et al U.S. Pat. No. 4,952,491 employed spectral sensitizing dyes and divalent sulfur atom containing heterocycles and acyclic compounds; and Ishiguro et al U.S. Pat. No. 4,983,508 employed organic bis-quaternary amine salts.

Bogg U.S. Pat. No. 4,063,951 reported the first tabular grain emulsions in which the tabular grains had parallel {100} major crystal faces. The tabular grains of Bogg exhibited square or rectangular major faces, thus lacking the three fold symmetry of conventional tabular grain {111} major crystal faces. Bogg employed an ammoniacal ripening process for preparing the tabular grains, thereby encountering the grain thickening and pH disadvantages discussed above in connection with Wey. Bogg conceded the process was feasible for producing individual grain aspect ratios no higher than 7:1. Thus, the average aspect ratio of a tabular grain emulsion so produced would necessarily be substantially less than 7. This is corroborated by Example 3 (the only emulsion described with grain features numerically characterized). The average aspect ratio of the emulsion was 2, with the highest aspect ratio grain (grain A in FIG. 3) being only 4. Bogg stated that the emulsions can contain no more than 1 percent iodide and demonstrated only a 99.5% bromide 0.5% iodide emulsion.

Mignot U.S. Pat. No. 4,386,156 represents an improvement over Bogg in that the disadvantages of ammoniacal ripening were avoided in preparing a silver bromide emulsion containing tabular grains with square and rectangular major faces. Mignot specifically requires ripening in the absence of silver halide ripening agents other than bromide ion (e.g., thiocyanate, thioether or ammonia). Mignot relies on excess bromide ion for ripening. Since silver bromide exhibits a solubility approximately two orders of magnitude lower than that of silver chloride, reliance on excess bromide ion for ripening precludes the formation of high chloride tabular grains.

Endo and Okaji, "An Empirical Rule to Modify the Habit of Silver Chloride to form Tabular Grains in an Emulsion", *The Journal of Photographic Science,* Vol. 36, pp. 182–188, 1988, discloses silver chloride emulsions prepared in the presence of a thiocyanate ripening agent. Emulsion preparations by the procedures disclosed has produced emulsions containing a few tabular grains within a general grain population exhibiting mixed {111} and {100} faces.

Mumaw and Haugh, "Silver Halide Precipitation Coalescence Processes", *Journal of Imaging Science,* Vol. 30, No. 5, Sep./Oct. 1986, pp. 198–299, is essentially cumulative with Endo and Okaji, with section IV-B being particularly pertinent.

Symposium: Torino 1963, *Photographic Science,* Edited by C. Semerano and U. Mazzucato, Focal Press 52–55, discloses ripening silver chloride emulsions.

(b) Epitaxial Deposition

Maskasky U.S. Pat. No. 4,435,501 (hereinafter referred to as Maskasky III) discloses the selective site epitaxial deposition onto high aspect ratio tabular grains through the use of a site director. Example site directors include various cyanine spectral sensitizing dyes and adenine. In Example 24B silver bromide was deposited epitaxially onto the edges of high chloride tabular grains. Emulsion preparation was conducted at a temperature of 55° C. while using a benzoxazolium spectral sensitizing dye as a site director for epitaxial deposition lacking a 5-iodo substituent and hence lacking the capability of acting as a morpholigical stabilizer.

Ogawa et al U.S. Pat. Nos. 4,786,588 and 4,791,053 disclose transhalogenation of high chloride nontabular grains by the addition of bromide ions. Transhalogenation combined with the use of a sulfur sensitizer or at least one spectral sensitizing dye is taught.

Hasebe et al U.S. Pat. Nos. 4,820,624 and 4,865,962 disclose producing emulsions containing grains that exhibit corner development by starting with a cubic or tetradecahedral host grain emulsion and adding silver bromide and spectral sensitizing dye or sulfur and gold sensitizing in the presence of an adsorbed organic compound.

Sugimoto and Miyake, "Mechanism of Halide Conversion Process of Colloidal AgCl Microcrystals by $Br^-$ Ions", Parts I and II, *Journal of Colloid and Interface Science,* Vol. 140, No. Dec. 1990, pp. 335–361, report observations of silver bromide deposition selectively onto the edges and corners of host cubic high chloride grains.

Techniques that result in the formation of silver bromide more or less uniformly over the surfaces of silver chloride host grains are disclosed by Houle et al U.S. Pat. No. 5,035,992; Japanese published applications (Kokai) 252649-A (priority 02.03.90-JP 051165 Japan) and 288143-A (priority 04.04.90-JP 089380 Japan).

Maskasky U.S. Ser. No. 764,868, filed Sep. 24, 1991, titled HIGH TABULARITY HIGH CHLORIDE EMULSIONS WITH INHERENTLY STABLE GRAIN FACES, now abandoned in favor of U.S. Ser. No. 955,010, filed Oct. 1, 1992, now allowed, but to be replaced by U.S. Ser. No. 35,349, filed Mar. 22, 1993 commonly assigned, hereinafter referred to as Maskasky IV, discloses high aspect ratio tabular grain high chloride emulsions containing tabular grains that are internally free of iodide and that have {100} major faces. In a preferred form, Maskasky IV employs an organic compound containing a nitrogen atom with a resonance stabilized $\pi$ electron pair to favor formation of {100} faces.

House et al U.S. Ser. No. 826,338, filed Jan. 27, 1992, titled HIGH ASPECT RATIO TABULAR GRAIN EMULSIONS AND PROCESSES FOR THEIR PREPARATION, now abandoned in favor of U.S. Ser. No. 940,404, filed Sep. 3, 1992, now allowed, but to be replaced by U.S. Ser. No. 34,060, filed Mar. 22, 1993 commonly assigned, hereinafter referred to as House et al, discloses high aspect ratio tabular grain high chloride emulsions containing tabular grains nucleated in the presence of iodide that have {100} major faces.

Maskasky U.S. Ser. No. 820,182, filed Jan. 13, 1992 (as a continuation-in-part of U.S. Ser. No. 763,030, filed Sep. 20, 1991) and commonly assigned, titled PROCESS FOR THE PREPARATION OF A GRAIN STABILIZED HIGH CHLORIDE TABULAR GRAIN .EMULSION (I), (hereinafter designated Maskasky V) now allowed, discloses a process for preparing a high chloride tabular grain emulsion in which morphologically unstable tabular grains having {111} major faces account for greater than 50 percent of total grain projected area and contain at least 50 mole percent chloride, based on silver. The emulsion additionally contains at least one 2-hydroaminoazine adsorbed to and morphologically stabilizing the tabular grains. Protonation releases 2-hydroaminoazine from the tabular grain surfaces. Released 2-hydroaminoazine is replaced on the tabular grain surfaces by adsorption of a photographically useful compound selected from among those that contain at least one divalent sulfur atom, thereby concurrently morphologically stabilizing the tabular grains and enhancing their photographic utility, and the released 2-hydroaminoazine is removed from the emulsion.

Maskasky U.S. Ser. No. 935,802, filed concurrently herewith and commonly assigned, titled PROCESS FOR THE PREPARATION OF A GRAIN STABILIZED HIGH CHLORIDE TABULAR GRAIN EMULSION (II), (hereinafter designated Maskasky VI) discloses a process essentially similar to that of Maskasky V, except that a 5-iodobenzoxazolium compound is substituted for the compound containing a divalent sulfur atom.

Maskasky U.S. Ser. No. 935,806, filed concurrently herewith and commonly assigned, titled PROCESS FOR THE PREPARATION OF A GRAIN STABILIZED HIGH CHLORIDE TABULAR GRAIN EMULSION (III), (hereinafter designated Maskasky VII) discloses a process essentially similar to that of Maskasky V, except that a cationic or zwitterionic benzimidazolium dye is substituted for the compound containing a divalent sulfur atom.

Maskasky U.S. Ser. No. 935,933, filed concurrently herewith and commonly assigned, titled PROCESS FOR THE PREPARATION OF A GRAIN STABILIZED HIGH CHLORIDE TABULAR GRAIN PHOTOGRAPHIC EMULSION (IV), (hereinafter designated Maskasky VIII) a process of preparing an emulsion for photographic use comprised of silver halide grains and a gelatino-peptizer dispersing medium in which morphologically unstable tabular grains having {111} major faces account for greater than 50 percent of total grain projected area and contain at least 50 mole percent chloride, based on silver. The emulsion additionally contains at least one 2-hydroaminoazine adsorbed to and morphologically stabilizing the tabular grains. A silver salt is deposited epitaxially at one or more corners of the tabular grains. Protonation releases 2-hydroaminoazine from the tabular grain surfaces into the dispersing medium. Released 2-hydroaminoazine is replaced on the tabular grain surfaces by adsorption of a photographically useful compound selected from among those that contain at least one stabilizing chalcogen atom or at least one 5-iodobenzoxazolium nucleus or a photographically useful cationic benzimidazolium dye, thereby concurrently morphologically stabilizing the tabular grains and enhancing their photographic utility, and the released 2-hydroaminoazine is removed from the dispersing medium.

SUMMARY OF THE INVENTION

In one aspect this invention is directed to a radiation sensitive emulsion containing a silver halide grain population comprised of at least 50 mole percent chloride, based on total silver forming the grain population, in which greater than 30 percent of the grain population projected area is accounted for by tabular grains having a mean thickness of less than 0.3 μm, wherein, the tabular grains have parallel major faces lying in {100} crystallographic planes and chemically sensitized silver halide epitaxial deposits containing less than 75 percent of the chloride ion concentration of the tabular grains and accounting for less than 20 mole percent of total silver are located at one or more of the corners of the tabular grains.

In another aspect this invention is directed to a process of preparing an emulsion for photographic use comprising (1) forming an emulsion containing a silver halide grain population comprised of at least 50 mole percent chloride, based on total silver forming the grain population, in which greater than 30 percent of the grain population projected area is accounted for by tabular grains having a mean thickness of less than 0.3 μm, (2) epitaxially depositing silver halide at one or more corners of the tabular grains, and (3) sensitizing the emulsion, wherein, (a) the tabular grains are formed with parallel major faces lying in {100} crystallographic planes, (b) the silver halide epitaxial deposit is selected to contain less than 50 percent of the chloride ion concentration of the tabular grains, (c) a photographically useful compound is adsorbed to the surfaces of the silver halide epitaxial deposits, and (d) the emulsion is chemically digested to increase its photographic speed while the adsorbed photographically useful compound acts as a morphological stabilizer and restrains chloride ion invasion of the epitaxial deposits at the corners of the tabular grains during chemical digestion.

The starting point for the practice of the invention lies in providing high chloride tabular grains having {100} major faces. These tabular grains exhibit all of the art recognized advantages of high tabularity, the art recognized advantages of high chloride, and, in addition, the advantage of high morphological stability attributable to the {100} major faces. This is in contrast to conventional high chloride tabular grain emulsions, which exhibit {111} major grain faces that are morphologically unstable. Instead of introducing parallel twin planes in grains as they are being formed to induce tabularity and thereby produce tabular grains with {111} major faces, it has been discovered that the presence of iodide in the dispersing medium during a high chloride nucleation step coupled with maintaining the chloride ion in solution within a selected pCl range results in the formation of a high aspect ratio tabular grain emulsion in which the tabular grains are bounded by {100} crystal faces. Alternative processes of preparation are disclosed that do not require the presence of iodide during grain nucleation and hence render iodide incorporation within the high chloride tabular grains of the invention a matter of choice.

After a high chloride tabular grain emulsion in which the tabular grains have parallel {100} faces with high levels of morphological stability are produced, the present invention makes possible high levels of photographic efficiency with minimized levels of fog. This is accomplished by forming silver halide epitaxial deposits at one or more of the corners of the host tabular grains followed by chemical sensitization. It has been discovered that superior photographic performance can be realized when the chloride content of the silver halide epitaxial deposits is held below that of the host tabular grains. This is achieved first by initially depositing the silver halide epitaxially with lower levels of incorporated chloride ion. It has further been discovered that chloride ion invasion of the silver halide epitaxial deposits can be restrained by adsorbing to the surfaces of the silver halide epitaxial deposits a photographically useful compound prior to undertaking chemical sensitization.

The photographic emulsions satisfying the requirements of the invention exhibit exceptionally high levels of photographic efficiency with minimal levels of fog. Partial grain development demonstrates that the epitaxial deposits are siting the latent images on the host tabular grains. The efficiency of photographic imaging is a function of the siting on the epitaxial deposits on the host grains, the maintenance of lower chloride ion levels in the silver halide epitaxy as compared to that of the host tabular grains, and the chemical sensitization of the silver halide epitaxial deposits.

The present invention is made possible by the discovery that chloride ion invasion of the epitaxial deposits as well as morphological stabilization of the epitaxial deposits so that they remain confined to their initial deposition sites on the corners of the host tabular grains with minimal spreading onto the surfaces of the host tabular grains can be maintained while undergoing chemical sensitization of the silver halide epitaxial deposits. Specifically, it has been observed that the adsorption of a photographically useful compound can restrain the chloride ion migration and silver halide epitaxial deposit recrystallization that occurs at the above ambient temperatures required for chemical sensitization. Unrestrained changes in the epitaxial deposits produce lower photographic efficiencies and higher levels of fog than occur when chemical digestion is carried out in the presence of an adsorbed photographically useful compound.

The invention then makes available highly photographically efficient and the most morphologically stable of high chloride tabular grain emulsions. The process of preparing the emulsions is superior to that employed to form similar high chloride emulsions containing tabular grains with {111} major grain faces, since no morphological stabilizer for the host tabular grains is required and the replacement with photographically useful compounds of photographically detrimental morphological stabilizers chosen solely for host tabular grain formation efficiency is entirely obviated.

BRIEF DESCRIPTION OF THE DRAWINGS

FIGS. 1, 4 and 6 demonstrate emulsions satisfying the requirements of the invention.

FIGS. 2, 3, 5 and 7 demonstrate control emulsions.

FIG. 8 is a host tabular grain emulsion.

DESCRIPTION OF PREFERRED EMBODIMENTS

The chemically sensitized high chloride tabular grain emulsions of the invention and their preparation are described by addressing the host tabular grain emulsion and its preparation under topic (a) below and then addressing the completion of the emulsion preparation under topic (b).

(a) The Host Tabular Grain Emulsion

The host tabular grain emulsions contain a silver halide grain population comprised of at least 50 mole percent chloride, based on total silver forming the grain population, in which greater than 30 percent of the grain population is accounted for by tabular grains having a mean thickness of less than 0.3 μm. The tabular grains have parallel major faces lying in {100} crystallographic planes.

In a preferred form of the invention, of the tabular grains bounded by {100} major faces those accounting for 50 percent of the total grain projected area, selected on the criteria of (1) adjacent major face edge ratios of less than 10, (2) thicknesses of less than 0.3 μm and (3) higher aspect ratios than any remaining tabular grains satisfying criteria (1) and (2), have an average aspect ratio of greater than 8.

Figure 8:
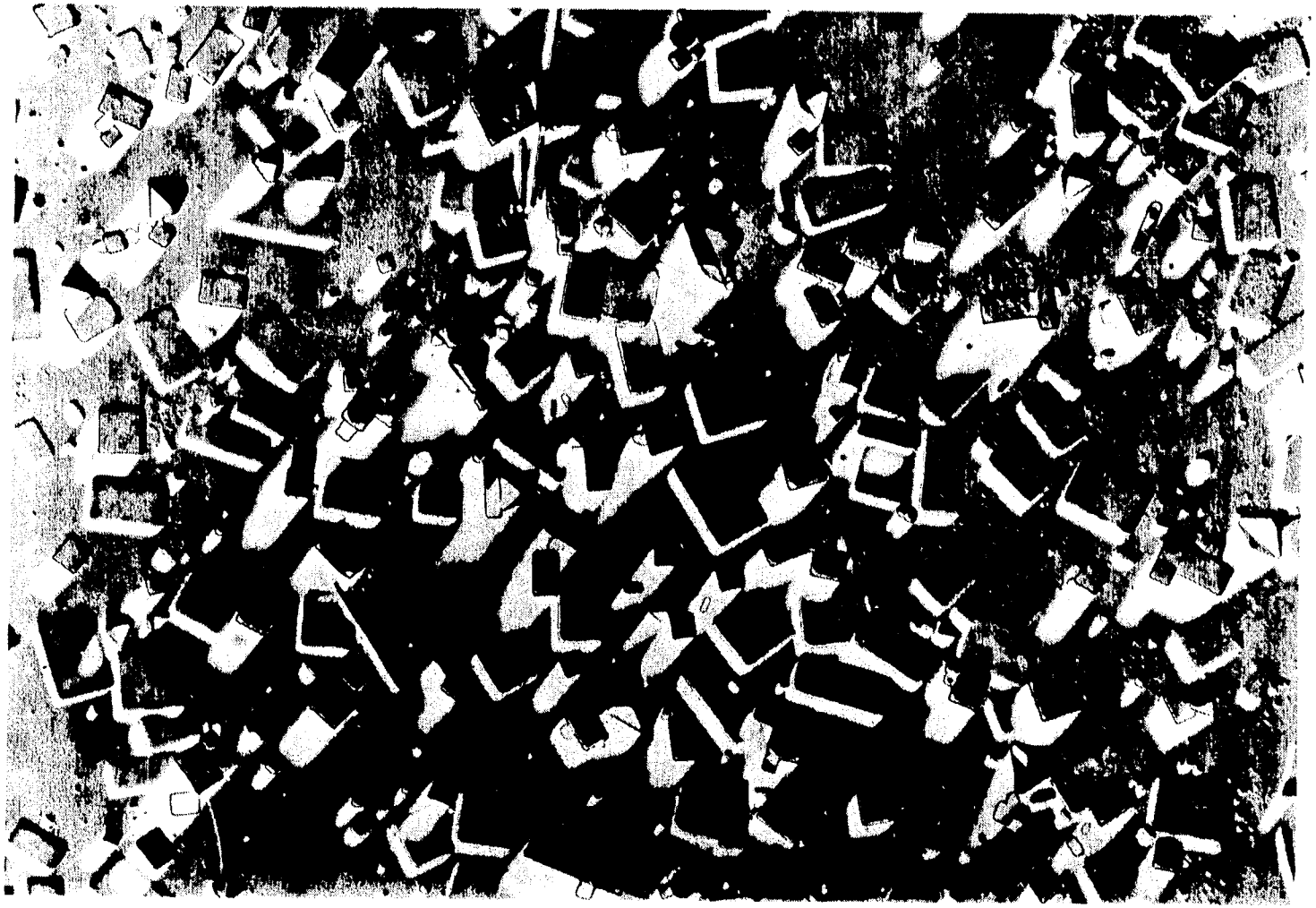

The identification of emulsions satisfying the requirements of the invention and the significance of the selection parameters can be better appreciated by considering a typical emulsion. FIG. 8 is a photomicrograph of shadowed carbon replicas of grains of a representative host tabular grain emulsion satisfying the requirements of the invention. It is immediately apparent that most of the grains have orthogonal tetragonal (square or rectangular) faces. The orthogonal tetragonal shape of the grain faces indicates that they are {100} crystal faces.

The projected areas of the few grains in the sample that do not have square or rectangular faces are noted for inclusion in the calculation of the total grain projected area, but these grains clearly are not part of the tabular grain population having {100} major faces.

A few grains may be observed that are acicular or rod-like grains (hereinafter referred as rods). These grains are more than 10 times longer in one dimension than in any other dimension and can be excluded from the desired tabular grain population based on their high ratio of edge lengths. The projected area accounted for by the rods is low, but, when rods are present, their projected area is noted for determining total grain projected area.

The grains remaining all have square or rectangular major faces, indicative of {100} crystal faces. Some of these grains are regular cubic grains. That is, they are grains that have three mutually perpendicular edges of equal length. To distinguish cubic grains from tabular grains it is necessary to measure the grain shadow lengths. From a knowledge of the angle of illumination (the shadow angle) it is possible to calculate the thickness of a grain from a measurement of its shadow length. The projected areas of the cubic grains are included in determining total grain projected area.

To quantify the characteristics of the tabular grains, a grain-by-grain examination of each of the remaining grains presenting square or rectangular faces is required. The projected area of each grain is noted for determination of total grain projected area.

Each of the grains having a square or rectangular face and a thickness of less than 0.3 μm is examined. The projected area (the product of edge lengths) of the upper surface of each grain is noted. From the grain projected area the ECD of the grain is calculated. The thickness (t) of the grain and its aspect ratio (ECD/t) of the grain are next calculated.

After all of the grains having a square or rectangular face and a thickness of less than 0.3 mm have been measured, these grains are rank ordered according to aspect ratio. The grain with the highest aspect ratio is rank ordered first and the grain with the lowest aspect ratio is rank ordered last.

Proceeding from the top of the aspect ratio rank ordering, sufficient tabular grains are selected to account for 50 percent of total grain projected area. The aspect ratios of the selected tabular grain population are then averaged. In the emulsions of the invention the average aspect ratio of the selected tabular grain population is greater than 8. In preferred emulsions according to the invention average aspect ratios of the selected tabular grain population are greater than 12 and optimally at least 15. Typically the average aspect ratio of the selected tabular grain population ranges up to 50, but higher aspect ratios of 100, 200 or more can be realized.

The selected tabular grain population accounting for 50 percent of total grain projected area preferably exhibits major face edge length ratios of less than 5 and optimally less than 2. The nearer the major face edge length ratios approach 1 (i.e., equal edge lengths) the lower is the probability of a significant rod population being present in the emulsion. Further, it is believed that tabular grains with lower edge ratios are less susceptible to pressure desensitization.

In one specifically preferred form of the invention the tabular grain population is selected on the basis of tabular grain thicknesses of less than 0.2 μm instead of 0.3 μm. In other words, the emulsions are in this instance thin tabular grain emulsions.

Surprisingly, ultrathin tabular grain emulsions have been prepared satisfying the requirements of the invention. Ultrathin tabular grain emulsions are those in which the selected tabular grain population is made of up tabular grains having thicknesses of less than 0.06 μm. Prior to the present invention the only ultrathin tabular grain emulsions of a halide content exhibiting a cubic crystal lattice structure known in the art contained tabular grains bounded by {111} major faces. In other words, it was thought essential to form tabular grains by the mechanism of parallel twin plane incorporation to achieve ultrathin dimensions. Emulsions according to the invention can be prepared in which the selected tabular grain population has a mean thickness down to 0.02 μm and even 0.01 μm. Ultrathin tabular grains have extremely high surface to volume ratios. This permits ultrathin grains to be photographically processed at accelerated rates. Further, when spectrally sensitized, ultrathin tabular grains exhibit very high ratios of speed in the spectral region of sensitization as compared to the spectral region of native sensitivity. For example, ultrathin tabular grain emulsions according to the invention can have entirely negligible levels of blue sensitivity, and are therefore capable of providing a green or red record in a photographic product that exhibits minimal blue contamination even when located to receive blue light.

The characteristic of tabular grain emulsions that sets them apart from other emulsions is the ratio of grain equivalent circular diameter (ECD) to thickness (t). This relationship has been expressed quantitatively in terms of aspect ratio (ECD/t). Another quantification that is believed to assess more accurately the importance of tabular grain thickness is tabularity:

$$T = ECD/t^2 = AR/t$$

where

T is tabularity;

AR is aspect ratio;

ECD is effective circular diameter in micrometers (μm); and t is grain thickness in micrometers.

The selected tabular grain population accounting for 50 percent of total grain projected area exhibits a tabularity of greater than 25 and preferably greater than 100. Since the selected tabular grain population can be ultrathin, it is apparent that extremely high tabularities, ranging to 1000 and above are within the contemplation of the invention.

The selected tabular grain population can exhibit an average ECD of any photographically useful magnitude compatible with a tabularity of greater than 25. For photographic utility average ECD's of less than 10 μm are contemplated, although average ECD's in most photographic applications rarely exceed 6 μm. A minimum ECD to satisfy minimum tabularity requirements with a minimum grain thickness of the selected tabular grain population is just greater than 0.25 μm. As is generally understood by those skilled in the art, emulsions with selected tabular grain populations having higher ECD's are advantageous for achieving relatively high levels of photographic sensitivity while selected tabular grain populations with lower ECD's are advantageous in achieving low levels of granularity.

So long as the selected population of tabular grains satisfying the parameters noted above accounts for at least 30 percent of total grain projected area a photographically desirable grain population is available. It is recognized that the advantageous properties of the emulsions of the invention are increased as the proportion of tabular grains having thicknesses of less than 0.3 μm and {100} major faces is increased. The preferred emulsions according to the invention are those in which at least 50 percent, most preferably at least 70 percent and optimally at least 90 percent of total grain projected area is accounted for by tabular grains having {100} major faces. It is specifically contemplated to provide emulsions satisfying the grain descriptions above in which the selection of the rank ordered tabular grains extends to sufficient tabular grains to account for 70 percent or even 90 percent of total grain projected area.

So long as tabular grains having the desired characteristics described above account for the requisite proportion of the total grain projected area, the remainder of the total grain projected area can be accounted for by any combination of coprecipitated grains. It is, of course, common practice in the art to blend emulsions to achieve specific photographic objectives. Blended emulsions that satisfy the selected tabular grain descriptions above are specifically contemplated, although it is usually preferred to defer blending until after epitaxial deposition has been completed and most often until after chemical sensitization has occurred.

If tabular grains having a thickness of less than 0.3 μm do not account for at least 30 percent (preferably at least 50 percent) of the total grain projected area, the emulsion does not satisfy the requirements of the invention and is, in general, a photographically inferior emulsion. For most applications (particularly applications that require spectral sensitization, require rapid processing and/or seek to minimize silver coverages) emulsions are photographically inferior in which many or all of the tabular grains are relatively thick——e.g., emulsions containing high proportions of tabular grains with thicknesses in excess of 0.3 μm. Emulsions containing thicker (up to 0.5 μm) tabular grains with {111} major faces, though generally inferior, have been suggested for use in the art to maximize capture of light in the spectral region to which silver halide exhibits native sensitivity (e.g., blue light). Emulsions containing thicker tabular grains having {100} major faces can be applied, if desired, to similar applications.

Obtaining host tabular grain emulsions satisfying the requirements of the invention has been made possible by the novel precipitation processes of Maskasky IV and House et al, cited above. In the House et al process grain nucleation occurs in a high chloride environment in the presence of iodide ion under conditions that favor the emergence of {100} crystal faces. As grain formation occurs the inclusion of iodide into the cubic crystal lattice being formed by silver ions and the remaining halide ions is disruptive because of the much larger diameter of iodide ion as compared to chloride ion. The incorporated iodide ions introduce crystal irregularities that in the course of further grain growth result in tabular grains rather than regular (cubic) grains.

It is believed that at the outset of nucleation the incorporation of iodide ion into the crystal structure results in cubic grain nuclei being formed having one or more screw dislocations in one or more of the cubic crystal faces. The cubic crystal faces that contain at least one screw dislocation thereafter accept silver halide at an accelerated rate as compared to the regular cubic crystal faces (i.e., those lacking a screw dislocation). When only one of the cubic crystal faces contains a screw dislocation, grain growth on only one face is accelerated, and the resulting grain structure on continued growth is a rod. The same result occurs when only two opposite parallel faces of the cubic crystal structure contain screw dislocations. However, when any two non-parallel cubic crystal faces contain screw dislocations, continued growth occurs more rapidly on both faces and produces a tabular grain structure. It is believed that the host tabular grains of the emulsions of this invention are produced by those grain nuclei having two, three or four faces containing screw dislocations.

At the outset of precipitation a reaction vessel is provided containing a dispersing medium and conventional silver and reference electrodes for monitoring halide ion concentrations within the dispersing medium. Halide ion is introduced into the dispersing medium that is at least 50 mole percent chloride——i.e., at least half by number of the halide ions in the dispersing medium are chloride ions. The pCl of the dispersing medium is adjusted to favor the formation of {100} grain faces on nucleation——that is, within the range of from 0.5 to 3.5, preferably within the range of from 1.0 to 3.0 and, optimally, within the range of from 1.5 to 2.5.

The grain nucleation step is initiated when silver ion is introduced into the dispersing medium. Iodide ion is preferably introduced into the dispersing medium concurrently with or, optimally, before the silver ion. Effective tabular grain formation can occur over a wide range of iodide ion concentrations ranging up to the saturation limit of iodide in silver chloride. The saturation limit of iodide in silver chloride is reported by H. Hirsch, "Photographic Emulsion Grains with Cores: Part I. Evidence for the Presence of Cores", J. of Photog. Science, Vol. 10 (1962), pp. 129–134, to be 13 mole percent. In silver halide grains in which equal molar proportions of chloride and bromide ion are present up to 27 mole percent iodide, based on silver, can be incorporated in the grains. It is preferred to undertake grain nucleation and growth below the iodide saturation limit to avoid the precipitation of a separate silver iodide phase and thereby avoid creating an additional category of unwanted grains. It is generally preferred to maintain the iodide ion concentration in the dispersing medium at the outset of nucleation at less than 10 mole percent and optimally at least than 5 mole percent. In fact, only minute amounts of iodide at nucleation are required to achieve the desired tabular grain population. Initial iodide ion concentrations of down to 0.001 mole percent are contemplated. However, for convenience in replication of results, it is preferred to maintain initial iodide concentrations of at least 0.01 mole percent and, optimally, at least 0.05 mole percent.

In the preferred form of the process silver iodochloride grain nuclei are formed during the nucleation step. Minor amounts of bromide ion can be present in the dispersing medium during nucleation. Any amount of bromide ion can be present in the dispersing medium during nucleation that is compatible with at least 50 mole percent of the halide in the grain nuclei being chloride ions. The grain nuclei preferably contain at least 70 mole percent and optimally at least 90 mole percent chloride ion, based on silver.

Grain nuclei formation occurs instantaneously upon introducing silver ion into the dispersing medium. For manipulative convenience and reproducibility, silver ion introduction during the nucleation step is preferably extended for a convenient period, typically from 5 seconds to less than a minute. So long as the pCl remains within the ranges set forth above no additional chloride ion need be added to the dispersing medium during the nucleation step. It is, however, preferred to introduce both silver and halide salts concurrently during the nucleation step. The advantage of adding halide salts concurrently with silver salt throughout the nucleation step is that this permits assurance that any grain nuclei formed after the outset of silver ion addition are of essentially similar halide content as those grain nuclei initially formed. Iodide ion addition during the nucleation step is particularly preferred. Since the deposition rate of iodide ion far exceeds that of the other halides, iodide will be depleted from the dispersing medium unless replenished.

Any convenient conventional source of silver and halide ions can be employed during the nucleation step. Silver ion is preferably introduced as an aqueous silver salt solution, such as a silver nitrate solution. Halide ion is preferably introduced as ammonium, alkali or alkaline earth halide, such as ammonium, lithium, sodium and/or potassium chloride, bromide and/or iodide.

It is possible, but not preferred, to introduce silver chloride or silver chloroiodide Lippmann grains into the dispersing medium during the nucleation step. In this instance grain nucleation has already occurred and what is referred to above as the nucleation step is in reality a step for introduction of grain facet irregularities. The disadvantage of delaying the introduction of grain facet irregularities is that this produces thicker tabular grains than would otherwise be obtained.

The dispersing medium contained in the reaction vessel prior to the nucleation step is comprised of water, the dissolved halide ions discussed above and a peptizer. The dispersing medium can exhibit a pH within any convenient conventional range for silver halide precipitation, typically from 2 to 8. It is preferred, but not required, to maintain the pH of the dispersing medium on the acid side of neutrality, preferably in a pH range of from 5,0 to 7.0. Mineral acids, such as nitric acid or hydrochloride acid, and bases, such as alkali hydroxides, can be used to adjust the pH of the dispersing medium. It is also possible to incorporate pH buffers.

The peptizer can take any convenient conventional form known to be useful in the precipitation of photographic silver halide emulsions and particularly tabular grain silver halide emulsions. A summary of conventional peptizers is provided in *Research Disclosure*, Vol. 308, December 1989, Item 308119, Section IX, the disclosure of which is here incorporated by reference. *Research Disclosure* is published by Kenneth Mason Publications, Ltd., Emsworth, Hampshire P010 7DD, England. While synthetic polymeric peptizers of the type disclosed by Maskasky I, cited above and here incorporated by reference, can be employed, it is preferred to employ gelatino peptizers (e.g., gelatin and gelatin derivatives). Specifically preferred peptizers are low methionine gelatino peptizers (i.e., those containing less than 30 micromoles of methionine per gram of peptizer), optimally less than 12 micromoles of methionine per gram of peptizer, these peptizers and their preparation are described by Maskasky II and King et al, cited above, the disclosures of which are here incorporated by reference. However, it should be noted that the grain growth modifiers of the type taught for inclusion in the emulsions of Maskasky I and II (e.g., adenine) are not appropriate for inclusion in the dispersing media of this invention, since these grain growth modifiers promote twinning and the formation of tabular grains having {111} major faces. Generally at least about 10 percent and typically from 20 to 80 percent of the dispersing medium forming the completed emulsion is present in the reaction vessel at the outset of the nucleation step. It is conventional practice to maintain relatively low levels of peptizer, typically from 10 to 20 percent of the peptizer present in the completed emulsion, in the reaction vessel at the start of precipitation. To increase the proportion of thin tabular grains having {100} faces formed during nucleation it is preferred that the concentration of the peptizer in the dispersing medium be in the range of from 0.5 to 6 percent by weight of the total weight of the dispersing medium at the outset of the nucleation step. It is conventional practice to add gelatin, gelatin derivatives and other vehicles and vehicle extenders to prepare emulsions for coating after precipitation. Any naturally occurring level of methionine can be present in gelatin and gelatin derivatives added after precipitation is complete.

The nucleation step can be performed at any convenient conventional temperature for the precipitation of silver halide emulsions. Temperatures ranging from near ambient——e.g., 30° C. up to about 90° C. are contemplated, with nucleation temperatures in the range of from 35° to 70° C. being preferred.

Since grain nuclei formation occurs almost instantaneously, only a very small proportion of the total silver need be introduced into the reaction vessel during the nucleation step. Typically from about 0.1 to 10 mole percent of total silver is introduced during the nucleation step.

A grain growth step follows the nucleation step in which the grain nuclei are grown until tabular grains having {100} major faces of a desired average ECD are obtained. Whereas the objective of the nucleation step is to form a grain population having the desired incorporated crystal structure irregularities, the objective of the growth step is to deposit additional silver halide onto (grow) the existing grain population while avoiding or minimizing the formation of additional grains. If additional grains are formed during the growth step, the polydispersity of the emulsion is increased and, unless conditions in the reaction vessel are maintained as described above for the nucleation step, the additional grain population formed in the growth step will not have the desired tabular grain properties described above.

In its simplest form the process of preparing host tabular grain emulsions can be performed as a single jet precipitation without interrupting silver ion introduction from start to finish. As is generally recognized by those skilled in the art a spontaneous transition from grain formation to grain growth occurs even with an invariant rate of silver ion introduction, since the increasing size of the grain nuclei increases the rate at which they can accept silver and halide ion from the dispersing medium until a point is reached at which they are accepting silver and halide ions at a sufficiently rapid rate that no new grains can form. Although manipulatively simple, single jet precipitation limits halide content and profiles and generally results in more polydisperse grain populations.

It is usually preferred to prepare photographic emulsions with the most geometrically uniform grain populations attainable, since this allows a higher percentage of the total grain population to be optimally sensitized and otherwise optimally prepared for photographic use. Further, it is usually more convenient to blend relatively monodisperse emulsions to obtain aim sensitometric profiles than to precipitate a single polydisperse emulsion that conforms to an aim profile.

In the preparation of host tabular grain emulsions it is preferred to interrupt silver and halide salt introductions at the conclusion of the nucleation step and before proceeding to the growth step that brings the emulsions to their desired final size and shape. The emulsions are held within the temperature ranges described above for nucleation for a period sufficient to allow reduction in grain dispersity. A holding period can range from a minute to several hours, with typical holding periods ranging from 5 minutes to an hour. During the holding period relatively smaller grain nuclei are Ostwald ripened onto surviving, relatively larger grain nuclei, and the overall result is a reduction in grain dispersity.

If desired, the rate of ripening can be increased by the presence of a ripening agent in the emulsion during the holding period. A conventional simple approach to accelerating ripening is to increase the halide ion concentration in the dispersing medium. This creates complexes of silver ions with plural halide ions that accelerate ripening. When this approach is employed, it is preferred to increase the chloride ion concentration in the dispersing medium. That is, it is preferred to lower the pCl of the dispersing medium into a range in which increased silver chloride solubility is observed. Alternatively, ripening can be accelerated by employing conventional ripening agents. Preferred ripening agents are sulfur containing ripening agents, such as thioethers. Typical thioether ripening agents are disclosed by McBride U.S. Pat. No. 3,271,157, Jones U.S. Pat. No. 3,574,628 and Rosencrantz et al U.S. Pat. No. 3,737,313, the disclosures of which are here incorporated by reference. More recently crown thioethers have been suggested for use as ripening agents.

Once the desired population of grain nuclei have been formed, grain growth to obtain the host tabular grain emulsions can proceed according to any convenient conventional precipitation technique for the precipitation of silver halide grains bounded by {100} grain faces. Screw dislocations, once introduced into the grain nuclei, persist even when screw dislocation producing conditions are not maintained during grain growth. Whereas iodide and chloride ions are required to be incorporated into the grains during nucleation and are therefore present in the completed grains at the internal nucleation site, any halide or combination of halides known to form a cubic crystal lattice structure can be employed during the growth step. This excludes only iodide levels above 13 mole percent (preferably 6 mole percent) in precipitating silver iodochloride, levels of iodide above 40 mole percent (preferably 30 mole percent) in precipitating silver iodobromide, and proportionally intermediate levels of iodide in precipitating silver iodohalides containing bromide and chloride. When silver bromide or silver iodobromide is being deposited during any portion of the growth step, it is preferred to maintain a pBr within the dispersing medium in the range of from 1.0 to 4.2, preferably 1.6 to 3.4. When silver chloride, silver iodochloride, silver bromochloride or silver iodobromochloride is being deposited during the growth step, it is preferred to maintain the pCl within the dispersing medium within the ranges noted above in describing the nucleation step.

During the growth step both silver and halide salts are preferably introduced into the dispersing medium. In other words, double jet precipitation is contemplated, with added iodide salt, if any, being introduced with the remaining halide salt or through an independent jet. The rate at which silver and halide salts are introduced is controlled to avoid renucleation——that is, the formation of a new grain population. Addition rate control to avoid renucleation is generally well known in the art, as illustrated by Wilgus German OLS No. 2,107,118, Irie U.S. Pat. No. 3,650,757, Kurz U.S. Pat. No. 3,672,900, Saito U.S. Pat. No. 4,242,445, Teitschied et al European Patent Application 80102242, and Wey "Growth Mechanism of AgBr Crystals in Gelatin Solution", *Photographic Science and Engineering*, Vol. 21, No. 1, Jan./Feb. 1977, p. 14, et seq.

Although the process of grain nucleation has been described above in terms of utilizing iodide to produce the crystal irregularities required for tabular grain formation, alternative nucleation procedures have been devised (note Host Emulsion B in the Examples below) that eliminate any requirement of iodide ion being present during nucleation in order to produce tabular grains. These alternative procedures are, further, compatible with the use of iodide during nucleation. Thus, these procedures can be relied upon entirely during nucleation for tabular grain formation or can be relied upon in combination with iodide ion during nucleation to produce tabular grains.

It has been observed that rapid grain nucleations, including so-called dump nucleations, in which significant levels of dispersing medium supersaturation with halide and silver ions exist at nucleation accelerate introduction of the grain irregularities responsible for tabularity. Since nucleation can be achieved essentially instantaneously, immediate departures from initial supersaturation to the preferred pCl ranges noted above are entirely consistent with this approach.

It has also been observed that maintaining the level of peptizer in the dispersing medium during grain nucleation at a level of less than 1 percent by weight enhances of tabular grain formation. It is believed that coalescence of grain nuclei pairs can be at least in part responsible for introducing the crystal irregularities that induce tabular grain formation. Limited coalescence can be promoted by withholding peptizer from the dispersing medium or by initially limiting the concentration of peptizer. Mignot U.S. Pat. No. 4,334,012 illustrates grain nucleation in the absence of a peptizer with removal of soluble salt reaction products to avoid coalescence of nuclei. Since limited coalescence of grain nuclei is considered desirable, the active interventions of Mignot to eliminate grain nuclei coalescence can be either eliminated or moderated. It is also contemplated to enhance limited grain coalescence by employing one or more peptizers that exhibit reduced adhesion to grain surfaces. For example, it is generally recognized that low methionine gelatin of the type disclosed by Maskasky II is less tightly absorbed to grain surfaces than gelatin containing higher levels of methionine. Further moderated levels of grain adsorption can be achieved with so-called "synthetic peptizers"——that is, peptizers formed from synthetic polymers. The maximum quantity of peptizer compatible with limited coalescence of grain nuclei is, of course, related to the strength of adsorption to the grain surfaces. Once grain nucleation has been completed, immediately after silver salt introduction, peptizer levels can be increased to any convenient conventional level for the remainder of the precipitation process.

The host tabular grain emulsions useful in the practice of the invention include silver chloride, silver bromochloride, silver iodochloride, silver iodobromochloride and silver bromoiodochloride emulsions, where halides present in higher concentrations are named after halides present in lower concentrations. The invention is particularly advantageous in providing high chloride (greater than 50 mole percent chloride) tabular grain emulsions, since conventional high chloride tabular grain emulsions having tabular grains bounded by {111} are inherently unstable and require the presence of a morphological stabilizer to prevent the grains from regressing to nontabular forms. Particularly preferred high chloride emulsions are according to the invention that are those that contain more than 70 mole percent (optimally more than 90 mole percent) chloride. Note that these ranges are based on total silver and hence include both the halide in the host tabular grains and the silver halide epitaxial deposits. However, since silver halide epitaxial deposits are typically quite small in relation to total silver, the same numerical ranges can also be applied to the host tabular grains alone. The host tabular grain emulsion can be pure silver chloride emulsions.

Although not essential to the practice of the invention, a further procedure that can be employed to maximize the population of tabular grains having {100} major faces is to incorporate an agent capable of restraining the emergence of non-{100} grain crystal faces in the emulsion during its preparation. The restraining agent, when employed, can be active during grain nucleation, during grain growth or throughout precipitation.

Useful restraining agents under the contemplated conditions of precipitation are organic compounds containing a nitrogen atom with a resonance stabilized $\pi$ electron pair. Resonance stabilization prevents protonation of the nitrogen atom under the relatively acid conditions of precipitation.

Aromatic resonance can be relied upon for stabilization of the $\pi$ electron pair of the nitrogen atom. The nitrogen atom can either be incorporated in an aromatic ring, such as an azole or azine ring, or the nitrogen atom can be a ring substituent of an aromatic ring.

In one preferred form the restraining agent can satisfy the following formula: (I)

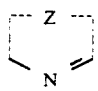

(I)

where

Z represents the atoms necessary to complete a five or six membered aromatic ring structure, preferably formed by carbon and nitrogen ring atoms. Preferred aromatic rings are those that contain one, two or three nitrogen atoms. Specifically contemplated ring structures include 2H-pyrrole, pyrrole, imidazole, pyrazole, 1,2,3-triazole, 1,2,4-triazole, 1,3,5-triazole, pyridine, pyrazine, pyrimidine, and pyridazine.

When the stabilized nitrogen atom is a ring substituent, preferred compounds satisfy the following formula:

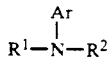

(II)

where

Ar is an aromatic ring structure containing from 5 to 14 carbon atoms and $R^1$ and $R^2$ are independently hydrogen, Ar, or any convenient aliphatic group or together complete a five or six membered ring.

Ar is preferably a carbocyclic aromatic ring, such as phenyl or naphthyl. Alternatively any of the nitrogen and carbon containing aromatic rings noted above can be attached to the nitrogen atom of formula II through a ring carbon atom. In this instance, the resulting compound satisfies both formulae I and II. Any of a wide variety of aliphatic groups can be selected. The simplest contemplated aliphatic groups are alkyl groups, preferably those containing from 1 to 10 carbon atoms and most preferably from 1 to 6 carbon atoms. Any functional substituent of the alkyl group known to be compatible with silver halide precipitation can be present. It is also contemplated to employ cyclic aliphatic substituents exhibiting 5 or 6 membered rings, such as cycloalkane, cycloalkene and aliphatic heterocylic rings, such as those containing oxygen and/or nitrogen hetero atoms. Cyclopentyl, cyclohexyl, pyrrolidinyl, piperidinyl, furanyl and similar heterocycylic rings are specifically contemplated.

The following are representative of compounds contemplated satisfying formulae I and/or II:

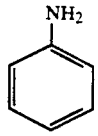

R-1 aniline

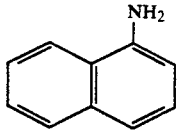

RA-2

α-naphthylamine

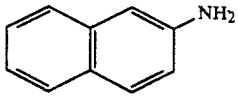

RA-3

β-naphthylamine

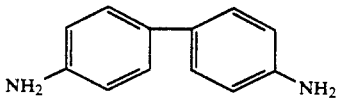

RA-4 benzidine

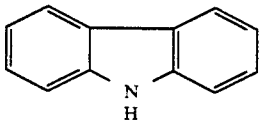

RA-5 carbazole

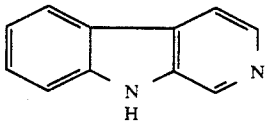

RA-6 norharman

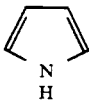

RA-7 pyrrole

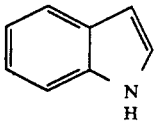

RA-8 indole

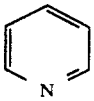

RA-9 pyridine

-continued
RA-10
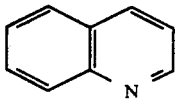
quinoline
RA-11
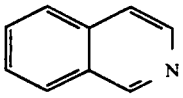
isoquinoline
RA-12
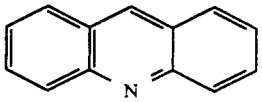
acridine
RA-13
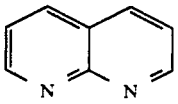
1,8-naphthyridine
RA-14
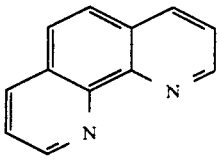
1,10-phenanthroline
RA-15
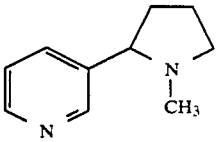
nicotine
RA-16
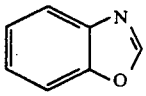
benzoxazole
RA-17
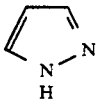
pyrazole
-continued
RA-18
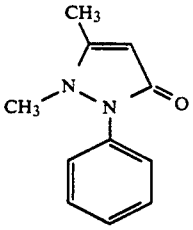
antipyrine
RA-19
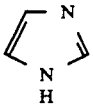
imidazole
RA-20
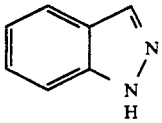
indazole
RA-21
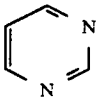
pyrimidine
RA-22
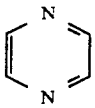
pyrazine
RA-23
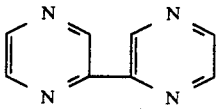
2,2'-bipyrazine
RA-24
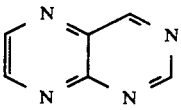
pteridine
RA-25
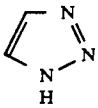
1,2,3-triazole
RA-26
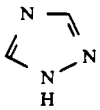
1,2,4-triazole -continued

RA-27

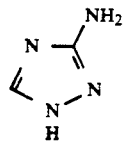

3-amino-1,2,4-triazole

RA-28

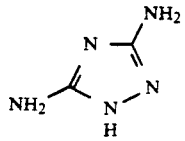

3,5-diamino-1,2,4-triazole

RA-29

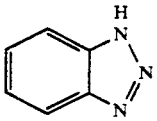

benzotriazole

RA-30

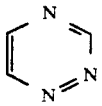

1,2,4-triazine

RA-31

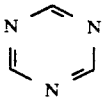

1,3,5-triazine

Selection of preferred restraining agents and their useful concentrations can be accomplished by the following selection procedure: The compound being considered for use as a restraining agent is added to a silver chloride emulsion consisting essentially of cubic grains with a mean grain edge length of 0.3 μm. The emulsion is 0.2M in sodium acetate, has a pCl of 2.1, and has a pH that is at least one unit greater than the pKa of the compound being considered. The emulsion is held at 75° C. with the restraining agent present for 24 hours. If, upon microscopic examination after 24 hours, the cubic grains have sharper edges of the {100} crystal faces than a control differing only in lacking the compound being considered, the compound introduced is performing the function of a restraining agent. The significance of sharper edges of intersection of the {100} crystal faces lies in the fact that grain edges are the most active sites on the grains in terms of ions reentering the dispersing medium. By maintaining sharp edges the restraining agent is acting to restrain the emergence of non-{100} crystal faces, such as are present, for example, at rounded edges and corners. In some instances instead of dissolved silver chloride depositing exclusively onto the edges of the cubic grains a new population of grains bounded by {100} crystal faces is formed. Optimum restraining agent activity occurs when the new grain population is a tabular grain population in which the tabular grains are bounded by {100} major crystal faces.

(b) Epitaxial Deposition and Chemical Sensitization

After forming a high chloride tabular grain host emulsion, silver halide epitaxy is selectively deposited on the high chloride tabular grains at their corners, where each corner of a tabular grain is considered to be formed by both of its major faces. The spacing between the major faces of the tabular grains is so small that adjacent corners of the major faces and the edge joining the major face corners (also referred to as a minor edge) are all considered to be part of the same tabular grain corner. Note that a single epitaxial deposit covers an entire corner portion of the grain and is confined to the corner area of the grain. In no instance does silver halide epitaxially deposited at one corner extend across the grain surface to form a continuous deposit with silver halide epitaxially deposited at another corner nor are epitaxial deposits present on any edge or face of the host tabular grain that are laterally offset from the corner area deposits. By the corner definition provided above, a tabular grain with {100}.major faces has 4 corners. Silver halide can be epitaxially deposited at only 1, 2, 3 or all four of the corners of a host tabular grain.

Any amount of silver halide can be employed that can be selectively deposited epitaxially at the corners of the tabular grains. Generally higher levels of sensitivity (and reduced risk of forming edge depositions separated from the corners of the tabular grains that can compete for photogenerated electrons) are realized when the silver halide is deposited at a concentration of less than 20 mole percent, based on total silver forming the composite grains (the host tabular grains and the epitaxial deposits). Preferably the concentration of silver salt is maintained less than 10 mole percent (and optimally less than 5 mole percent) based on the total silver forming the composite grains. Only very small amounts of epitaxially deposited silver halide are effective to produce latent image sites selectively at the corners of the tabular grains. Silver halide epitaxial depositions that are too small to be observed by microscopic examination have been found to be effective in locating latent image sites. Maskasky III (U.S. Pat. No. 4,435,501) discloses incremental sensitivity to result from silver salt concentrations as low as 0.05 mole percent, based on total silver present in the composite grains, with silver salt concentrations of at least 0.3 mole percent being preferred.

The silver halide epitaxial deposits can be chosen from among any of the various silver halides known to form sensitizing epitaxial deposits on silver chloride host grains. The epitaxial deposits contemplated for use in the practice of this invention are those that are capable of locating the latent image sites formed by exposure. If the silver halide deposited at the tabular grain corners and the host tabular grain are of the same composition, the silver halide at the corners of the host tabular grains simply merges with the tabular grain host and provides no advantageous effect. Note that corner deposited silver halides that correspond to the composition of the host tabular grains are not within the art recognized definition of epitaxy, which requires a detectable difference between the deposited silver halide and the host. Generally some (usually at least about 5 mole percent) silver chloride will be occluded in the silver halide as it is epitaxially deposited, but it is generally contemplated that the silver halide as epitaxially deposited before chemical sensitization must contain no more than 50 percent (preferably no more than 30 percent and optimally no more than 20 percent) the molar concentration of silver chloride in the host tabular grain to be effective in locating a latent image site during exposure. The addition of bromide ion or a combination of bromide ion and a lower proportion of iodide ion during precipitation is capable of producing preferred silver halide epitaxial depositions at the corners of the host tabular grains.

The silver ion required for formation of the epitaxial deposits can be supplied in whole or in part by metathesis of the host tabular grain (i.e., silver ion displacement from the host tabular grain). In addition to halide ion introduction, silver ion can also be run into the emulsion during silver salt epitaxial deposition (e.g., by the addition of $AgNO_3$). It is contemplated, but not necessary, that sufficient silver ion be introduced during epitaxial deposition that the amount of silver ion introduced at least equals to amount of silver ion epitaxially deposited.

It is preferred to limit the iodide content of the silver halide epitaxially deposited to less than 20 (optimally less than 10) mole percent. The preferred silver halide composition of the epitaxial deposits is then silver chlorobromide, silver iodochlorobromide or (less commonly) silver chloroiodobromide, where the halide of higher concentration is named after the halide of lower concentration. When the host tabular grains consist essentially of silver chloride, the silver halide epitaxially deposited can, prior to chemical sensitization, range up to 50 percent of the chloride concentration of the host tabular grains——i.e., up to 50 mole percent chloride. When the host tabular grains consist essentially of just greater than 50 mole percent silver chloride, the silver halide epitaxially deposited can range to a chloride concentration of up to 50 percent the chloride concentration of the host tabular grains——i.e., up to 25 mole percent chloride. Silver bromide can form the balance of the silver halide epitaxy. When silver iodide is incorporated in the epitaxial deposits, preferably less than 20 mole percent and, optimally, less than 10 mole percent of the silver halide epitaxially deposited is accounted for by iodide, based on silver in the epitaxially deposited silver halide.

Although the discussion of the composition of both the host tabular grains and the silver halide epitaxially deposited has been limited to the silver halide content, it is recognized that the silver halide at either or both locations can contain conventional occlusions of other ingredients. For example, conventional silver halide grain dopants, such as those disclosed by *Research Disclosure,* Section I, subsection D, here incorporated by reference, of Item 308119, cited above, can be included in one or both of the host tabular grains and the silver halide epitaxially deposited. It is preferred that grain dopants that enhance capture of photogenerated conductance band electrons be placed preferentially in the silver halide epitaxially deposited, since this enhances the latent image forming capacity of the silver halide epitaxial deposits at the corners of the grains. Dopants that serve other photographic functions can be located in either the host grain or the corner silver halide deposits. Considerations such as compatibility with corner sensitization and host grain tabularity can direct the dopant to one location or the other.

In attempting to provide tabular grain emulsions with corner silver halide epitaxial deposits one of the failure modes is for silver halide to spread over the tabular grain surfaces rather than remaining confined to corner areas. Generally a progressive failure of epitaxial siting can be observed as conditions are varied, ranging from the desired corner siting of silver halide epitaxially deposited, to edge and corner siting of silver halide epitaxially deposited, to broad surface coverage of the host tabular grains by the silver halide epitaxially deposited, and, in the extreme, to continuous shelling of the host tabular grain by the silver halide epitaxially deposited. With each broadening of the areas occupied by the silver halide epitaxially deposited competition for photogenerated electrons is increased and photographic efficiency is reduced.

One of the advantages of employing high chloride tabular host grains having {100} major surfaces lies in the recognition that the preferred deposition sites for silver halide epitaxial deposition is at the corners of the grains. Thus, it is unnecessary to modify the composition of the host tabular grains or to adsorb any particular compound to the surfaces of the host tabular grains having {100} major faces to realize corner selective deposition. Nevertheless, there are limits to the conditions that permit silver halide epitaxial deposits of the type described above and satisfying the requirements of this invention to be confined to the corner areas of the tabular grains with {100} major faces. The temperature of deposition and the rate of deposition must be controlled to obtain epitaxial deposition selectively at the corners of the tabular grains and also to limit chloride introduction into the epitaxy from the host tabular grains. Relatively low temperatures of epitaxial deposition are contemplated, preferably less than 45° C. This leaves a convenient working range for epitaxial deposition of down to about 15° C. As previously noted, at 55° C. Maskasky (III), cited above, formed epitaxial deposits that were edge specific, but not confined to the corners of host high chloride tabular grains.

It has been observed that epitaxial deposition exclusively onto the corners of the high chloride tabular grains with {100} major faces can be achieved at deposition rates of less than $5\times10^{-17}$ mol per corner-minute. From a knowledge of the moles of silver present in an emulsion and the shape and size of the grains, it is possible to calculate the number of grain corners present. From this knowledge the maximum acceptable deposition rate per grain corner can be established. If the critical rate of silver salt addition is exceeded, epitaxial deposition will first spread to the edges of the tabular grains at locations remote from the corners and then onto the major faces of the host tabular grains. With a further increase in the introduction rate, renucleation occurs——that is, an entirely new grain population is formed.

Conversely, by slowing epitaxial deposition so that high levels of silver salt supersaturation are avoided, very selective epitaxial deposition can be achieved. It is possible, for example, to limit epitaxial deposition not only to the corners of the tabular grains, but limit epitaxial deposition to only a portion of the tabular grain corners. It is possible to prepare tabular grain emulsions in which there is a distribution of silver halide corner epitaxial deposits ranging from deposits at each tabular grain corner to deposits at only one tabular grain corner. It is possible to obtain emulsions according to the invention in which tabular grains having epitaxial deposits limited to only one or two corners account for the majority of the tabular grain population. By reducing the number of epitaxial deposition sites per grain competition between these sites for photogenerated electrons is reduced and the capacity for achieving higher photographic speeds is enhanced.

While depositing silver halide at the corners of the host tabular grains is in itself effective to improve photographic performance, the highest levels of photographic efficiency (conventionally measured in terms of one or a combination of speed, granularity and fog) are realized when the emulsions are chemically sensitized. Particularly, to enhance latent image formation at the corners of the tabular grains, the silver halide epitaxially deposited is chemically sensitized. Any convenient conventional chemical sensitization technique can be employed. Chemical sensitizations are illustrated by *Research Disclosure,* Item 308119, cited above, Section III, the disclosure of which is here incorporated by reference. The chemical sensitization of photographic emulsions is also discussed by James *The Theory of the Photographic Process,* 4th Ed., Macmillan, New York, 1977, Chapter 5, subsection I, pp. 149-160, the disclosure of which is here incorporated by reference. There are three broad categories of chemical sensitizations in common use. These are (1) noble metal sensitizations, of which gold sensitizations are most common, (2) middle chalcogen (S, Se and/or Te) sensitizations, of which sulfur (and to a less extent selenium) sensitizations are most common, and (3) reduction sensitizations. Combinations of these alternative chemical sensitizations are known and commonly employed, since higher levels of photographic sensitivity can be realized with combinations than with any one sensitization taken alone. Combinations of (2) and (3) sensitizations are common——e.g., reduction and sulfur sensitizations. The most popular sensitizations are combinations of (1) and (2), particularly gold chemical sensitization employed in combination with one or both of sulfur and selenium sensitizations.

Unfortunately, all commonly employed chemical sensitizations require an emulsion to be heated to and held at a temperature well above ambient. Typically chemical sensitizations are undertaken in the temperature range of from 45° to 75° C., although for short holding periods even higher temperatures are feasible.

If an emulsion having high chloride host tabular grains with silver halide corner epitaxially deposited is heated to and held at the temperatures conventionally employed to achieve chemical sensitization, absent preventive techniques described below, both structural and photographic performance degradation of the emulsion occurs. From photomicrographs of emulsion samples taken before and after heating it is readily apparent that the silver halide epitaxial deposits have spread away from the corner areas of the host grains. Less than extreme chemical sensitization heating conditions are required to eliminate all visual evidence of epitaxial deposits at the corners of the host tabular grains. By analysis of the silver halide epitaxially deposited on the host tabular grain corners before and after chemical sensitization heating, it has been determined that the proportion of chloride in the silver halide deposits at the corners has also increased. While there is no intention of being bound by any particular theory to account for the degradation of photographic performance observed, it is believed that the areally spread and chloride ion invaded silver halide remaining on the surface of the host tabular grains after heating without otherwise protecting the silver halide epitaxially deposited has been degraded both in its ability to locate latent image sites at their optimum sites (the corners of the grains) and in its ability to capture photogenerated conductance band electrons with minimal sensitivity reducing competition among grain surface sites.

It has been observed that, when a photographically useful compound is adsorbed to the surfaces of the grains of the emulsion after epitaxial deposition and before chemical sensitization, during subsequent chemical sensitization morpological stabilization of the silver halide epitxially deposited at the corners of the host tabular grains is achieved and invasion of chloride ion into the silver halide epitaxially deposited is restrained. From microscopic observations before and after chemical sensitization it has been observed that limited migration of silver halide corner epitaxial deposits can be realized. Further, from composition analysis it has been concluded that after chemical sensitization the chloride ion concentration of the silver halide epitaxially deposited remains less than 75 percent that of the host tabular grains. It is possible and preferred in the practice of the invention to maintain the concentration of chloride ions in the silver halide epitaxy to less than 50 percent (optimally less than 30 percent) of the chloride ion concentration in the host tabular grains. Further, it has been observed that when an adsorbed photographically useful compound is present, it is possible to conduct chemical sensitizations in a conventional manner (that is, to employ conventional chemical sensitization heating temperatures and hold times) while achieving improved photographic performance.

Any of the various photographically useful emulsion addenda known to adsorb to the silver halide grain surfaces are specifically contemplated for use in the practice of the invention. A wide choice of photographically useful compounds are available from among conventional spectral sensitizing dyes, antifoggants and stabilizers, each of which are almost always also adsorbed to grain surfaces in use. Examples of such compounds are provided by *Research Disclosure,* cited above, Section IV Spectral sensitization and desensitization and Section VI Antifoggants and stabilizers, the disclosure of which is here incorporated by reference.

Photographically useful adsorbed compounds are preferably selected from among any of the compounds capable of morphologically stabilizing high chloride tabular grains having {111} major surfaces. However, the inherent stability of high chloride tabular grains having {100} major faces allows adsorbed photographically useful compounds to be employed in the practice of the invention that have not been used successfully to stabilize high chloride tabular grains with {111} major faces. The reason for this is that the adsorbed photographically useful compound is, in the practice of the invention, relied upon to morphologically stabilize the silver halide epitaxial deposits only, whereas in failure to stabilize epitaxial deposits on tabular grains with {111} major faces is often a result of the instability of the host grain itself.

In one preferred form of the invention photographically useful compounds capable of acting as morphological stabilizers can be chosen from among photographically useful compounds containing at least one divalent sulfur atom. Spectral sensitizing dyes, desensitizers, hole trapping dyes, antifoggants, stabilizers and development modifiers are illustrations of different classes of photographically useful compounds that can be selected to contain one or more divalent sulfur atom containing moieties. A wide variety of photographically useful compounds containing one or more divalent sulfur atoms is disclosed in *Research Disclosure,* Item 308119, cited above and here incorporated by reference.

The following are illustrative of varied divalent sulfur atom moieties commonly found in photographically useful compounds:

$-S-H$ M-1
mercapto $-S-R^a$ M-2 where $R^a$ is any convenient hydrocarbon or substituted hydrocarbon——e.g., when $R^a$ an alkyl group the resulting moiety is an alkylthio moiety (methylthio, ethylthio, propylthio, etc.) and when $R^a$ is an aromatic group the resulting moiety is an arylthio moiety (phenylthio, naphthylthio, etc.) or $R^a$ can be a heterocyclic nucleus, such as any of the various heterocyclic nuclei found in cyanine dyes $-S-S-R^a$ M-3 where $R^a$ is as described above

| | |
|---|---|
| M-4 | 1,4-thiazine |
| M-5 | thiazoline |
| M-6 | thiazole |
| M-7 | thiophene |
| M-8 | 3-thia-1,4-diazole |
| M-9 | benzothiazole |
| M-10 | naphtho[2.1-d]thiazole |
| M-11 | naphtho[1,2-d]thiazole |
| M-12 | naphtho[2,3-b]thiazole |
| M-13 | thiazolo[4,5-b]quinoline |
| M-14 | 4,5-dihydrobenzothiazole |
| M-15 | 4,5,6,7-tetrahydrobenzothiazole |
| M-16 | 4,5-dihydronaptho[1,2-d]thiazole |
| M-17 | phenanthrothiazole |
| M-18 | acenaphthothiazole |
| M-19 | isorhodanine |
| M-20 | rhodanine |
| M-21 | thiazolidin-2,4-dione |
| M-22 | thiazolidin-2,4-dithione |
| M-23 | 2-dicyanomethylenethiazolidin-4-one |
| M-24 | 2-diphenylamino-1,3-thiazolin-4-one |
| M-25 | benzothiophen-3-one |

The moieties M-1 to M-8 as well as some of the subsequent moieties, such as M-9 and M-20, are commonly encountered in various photographically useful compounds such as antifoggants, stabilizers and development modifiers. The moieties M-5 to M-18 are common heterocyclic nuclei in polymethine dyes, particularly cyanine and merocyanine sensitizing dyes. The moieties M-19 to M-25 are common acidic nuclei in merocyanine dyes. The heterocyclic moieties M-4 to M-25 are named as rings, since the site of ring attachment can be at any ring carbon atom and ring, substituents, if any, can take any convenient conventional form, such as any of the various forms described above in connection with $R^a$.

It is recognized that other middle chalcogen atoms are capable of providing the same effect as divalent sulfur atoms. There are direct analogues of most photographically useful divalent sulfur atom containing compounds in the form of corresponding divalent selenium atom containing compounds. Further, photographically useful tellurium atom containing compounds are known. A variety of such compounds are disclosed, for example, in Gunther et al U.S. Pat. Nos. 4,581,330, 4,599,410 and 4,607,000, the disclosure of which are here incorporated by reference. Tellurium atoms can replace divalent sulfur and selenium atoms in aromatic heterocyclic nuclei, although the tellurium atoms are generally tetravalent rather than divalent.

Another specifically contemplated class of photographically useful compounds capable of acting as morphological stabilizers are cyanine dyes (e.g., monomethine cyanine dyes, carbocyanine dyes, dicarbocyanine dyes, etc.) and photographically useful compounds containing at least one basic heterocyclic nucleus of the type found in cyanine dyes (e.g., merocyanine dyes, which always contain one cyanine dye type nucleus). Typical basic heterocyclic nuclei of the type found in cyanine dyes include quinolium, pyridinium, isoquinolinium, 3H-indolium, benz[e]indolium, oxazolium, thiazolium, selenazolinium, imidazolium, benzoxazolinium, benzothiazolium, benzoselenazolium, benzimidazolium, naphthoxazolium, naphthothiazolium, naphthoselenazolium, thiazolinium, dihydronaptho-thaizolium, pyrylium and imidazopyrazinium cyanine dye nuclei. Cyanine dye nuclei contain at least one nitrogen heteroatom in a five or six membered heterocyclic ring, often in combination with a chalcogen atom, such as oxygen, sulfur or selenium. Benzo or naphtho rings are commonly fused to the heterocyclic rings to enhance stability and/or shift light absorption to longer wavelengths.

A wide variety of conventional photographically useful emulsion addenda containing the types of basic nuclei found in cyanine dyes are available to choose among. Spectral sensitizing dyes, desensitizers, hole trapping dyes, antifoggants, stabilizers and development modifiers are illustrations of different classes of photographically useful compounds that are known to contain at least one basic heterocyclic nucleus of the type found in cyanine dyes. Examples of such photographically useful compounds can be found in *Research Disclosure,* Item 308,119, cited above, Section IV. Spectral sensitization and desensitizaton; Section V. Brighteners; Section VI. Antifoggants and stabilizers; Section VIII. Absorbing and scattering materials; and Section XXI. Development modifiers, the disclosure of which is here incorporated by reference.

The photographically useful compound is typically introduced into the dispersing medium in an amount sufficient to provide from at least 20 percent to 100 percent (preferably 50 percent) of monomolecular coverage on the host grain surfaces, bearing in mind that referencing the concentration of photographically useful compound to the host grain surfaces is merely a quantification convenience. In fact the morphological stabilization sought is to the silver halide epitaxially deposited on the host tabular grains, since the {100} faces of the host grains are inherently stable. By reason of the differences in halide composition of the host grain and the epitaxial deposits the photographically useful compound can be preferentially adsorbed to the surface of the silver halide epitaxially deposited. To the extent that the photographically useful compound is adsorbed selectively to the silver halide epitaxially deposited on the host tabular grains even lower concentrations of the photographically useful compound can be effective to achieve morphological stabilization. Introducing greater amounts of the photographically useful compound than can be adsorbed on grain surfaces is inefficient, since unadsorbed compound is susceptible to removal from the emulsion during subsequent washing.

Apart from the features that have been specifically discussed, the tabular grain emulsion preparation procedures, the tabular grains that they produce, and their further use in photography can take any convenient conventional form. Such conventional features are illustrated by the following incorporated by reference disclosures:

| | |
|---|---|
| ICBR-1 | Research Disclosure, Vol. 308, December 1989, Item 308,119; |
| ICBR-2 | Research Disclosure, Vol. 225, January 1983, Item 22,534; |
| ICBR-3 | Wey et al U.S. Pat. No. 4,414,306, issued Nov. 8, 1983; |
| ICBR-4 | Solberg et al U.S. Pat. No. 4,433,048, issued Feb. 21, 1984; |
| ICBR-5 | Wilgus et al U.S. Pat. No. 4,434,226, issued Feb. 28, 1984; |
| ICBR-6 | Maskasky U.S. Pat. No. 4,643,966, issued Feb. 17, 1987; |
| ICBR-7 | Daubendiek et al U.S. Pat. No. 4,672,027, issued Jan. 9, 1987; |
| ICBR-8 | Daubendiek et al U.S. Pat. No. 4,693,964, issued Sept. 15, 1987; |
| ICBR-9 | Maskasky U.S. Pat. No. 4,713,320, issued Dec. 15, 1987; |
| ICBR-10 | Saitou et al U.S. Pat. No. 4,797,354, issued Jan. 10, 1989; |
| ICBR-11 | Ikeda et al U.S. Pat. No. 4,806,461, issued Feb. 21, 1989; |
| ICBR-12 | Makino et al U.S. Pat. No. 4,853,322, issued Aug. 1, 1989; and |
| ICBR-13 | Daubendiek et al U.S. Pat. No. 4,914,014, issued Apr. 3, 1990. |

EXAMPLES

The invention can be better appreciated by reference to the following examples.

Host Emulsion A

High-Aspect-Ratio Iodide Containing High-Chloride {100} Tabular Grain Emulsion A reaction vessel contained 2L of a solution that was 3.5% in low methionine (oxidized) gelatin, 5.6 mM in NaCl and 0.15 mM in KI. To this stirred solution at 40° C. was added simultaneously and at 60 mL/min each, 0 30 mL of a solution 2M in $AgNO_3$ and 30 mL of a solution 1.99M in NaCl and 0.01M in KI. The mixture was stirred for 10 min and then 1.88L of a solution 0.5M in $AgNO_3$ was added first at 8.0 mL/min for 40 min, then the flow rate was accelerated 2× requiring 130 min. A solution 0.5M in NaCl was concurrently added as needed to maintain a constant pCl of 2.32. To the resulting emulsion was added 20 g of phthalated gelatin and it was washed by the coagulation method of U.S. Pat. No. 2,614,929, and finally resuspended in 500 mL of a 1% gelatin solution, then adjusted to a pCl of 2.07. The total gelatin content was approximately 20 g/mole.

The emulsion consisted of a {100} tabular grain population making up 75% of the projected area of the emulsion grains. This population had a mean diameter of 1.66 μm, and a mean thickness of 0.11 μm.

Host Emulsion B

High-Aspect-Ratio Pure Chloride {100} Tabular Grain Emulsion

A reaction vessel contained 2L of a solution that was 0.5% in bone gelatin, 6 mM in 3-amino-1H-1,2,4-triazole, 0.040M in NaCl, and 0.20M in sodium acetate. The solution was adjusted to pH 6.1 at 55° C. To this solution at 55° C. were added simultaneously 25 mL of 4M $AgNO_3$ and 25 mL of 4M NaCl at a rate of 25 mL/min each. The temperature of the mixture was then increased to 75° C. at a constant rate requiring 12 min and then held at this temperature for 5 min. The pH was adjusted to 6.2 and held to within ±0.1 of this value during the rest of the precipitation. The flow of the $AgNO_3$ solution was resumed at 25 mL/min until 4 moles of Ag had been added and the flow of the NaCl solution was resumed but at a rate needed to maintain a constant pCl of 1.50. The emulsion was cooled to 40° C., then 4L of distilled water was added. After standing at 2° C. for 24 hrs, the solid phase was discarded and 12 g of phthalated gelatin was added to the supernatant. It was washed using the coagulation method of U.S. Pat. No. 2,614,929 and then resuspended in 50 mL of 2% gelatin.

The final emulsion consisted of a {100} tabular grain population making up 70% of the projected area of the emulsion grains. This population had a mean equivalent circular diameter of 1.81 μm, and a mean thickness of 0.173 μm.

Example 1

Effect of Bromide Ion Addition Rate on the Location of Epitaxial Deposits

To stirred 50 g portions (0.05M) of Host Emulsion A at 25° C., pCl of 2.06 were added 0.001 mole of sodium bromide solutions at 0.5 ml/min whose concentrations and quantities are given in Table I. The resulting emulsions were examined by electron microscopy to determine the primary location of any epitaxial growths. The results are given in Table I.

The halide composition of individual grains of Example lb were analyzed at 100° K. using a Philips CM-12 Analytical Transmission Electron Microscope. X-ray energy-dispersive spectra were collected from epitaxial growths on 4 grains. The growths had a mean composition of 62 mol % bromide.

TABLE I

| Emulsion | NaBr sol. conc. (M) | Total NaBr sol. added (ml) | Calculated Growth Rate (mol epitaxy per corner-min) × $10^{17}$ | Observed location of epitaxy |
|---|---|---|---|---|
| Control 1a | 2.00 | 0.5 | 6.0 | Corners & edges |
| Example 1b | 0.20 | 5.0 | 0.6 | Corners only |
| Example 1c | 0.02 | 50.0 | 0.06 | Corners only |

Example 2

Sulfur Sensitized, Corner Epitaxial Emulsion Made with $Br^-$

A stirred 50 g portion (0.05 mole) of Host Emulsion A at 25° C. was adjusted to pH 5.3 with $H_2SO_4$ and pCl of 2.06 with NaCl. To this emulsion was added 5 mL of a solution of 0.2M NaBr at 0.5 mL/min. When 0.5 mL of this solution was added, 1 mL of a 1.44 mM sodium thiosulfate solution was concurrently added requiring 15 sec. From electron microscopy the resulting epitaxial emulsion was found to have epitaxial deposits exclusively at the corners of the tabular grains, while these deposits were absent from the starting host emulsion grains.

The epitaxial emulsion was divided into two equal parts.

Example Part 2ax

Figure 1:
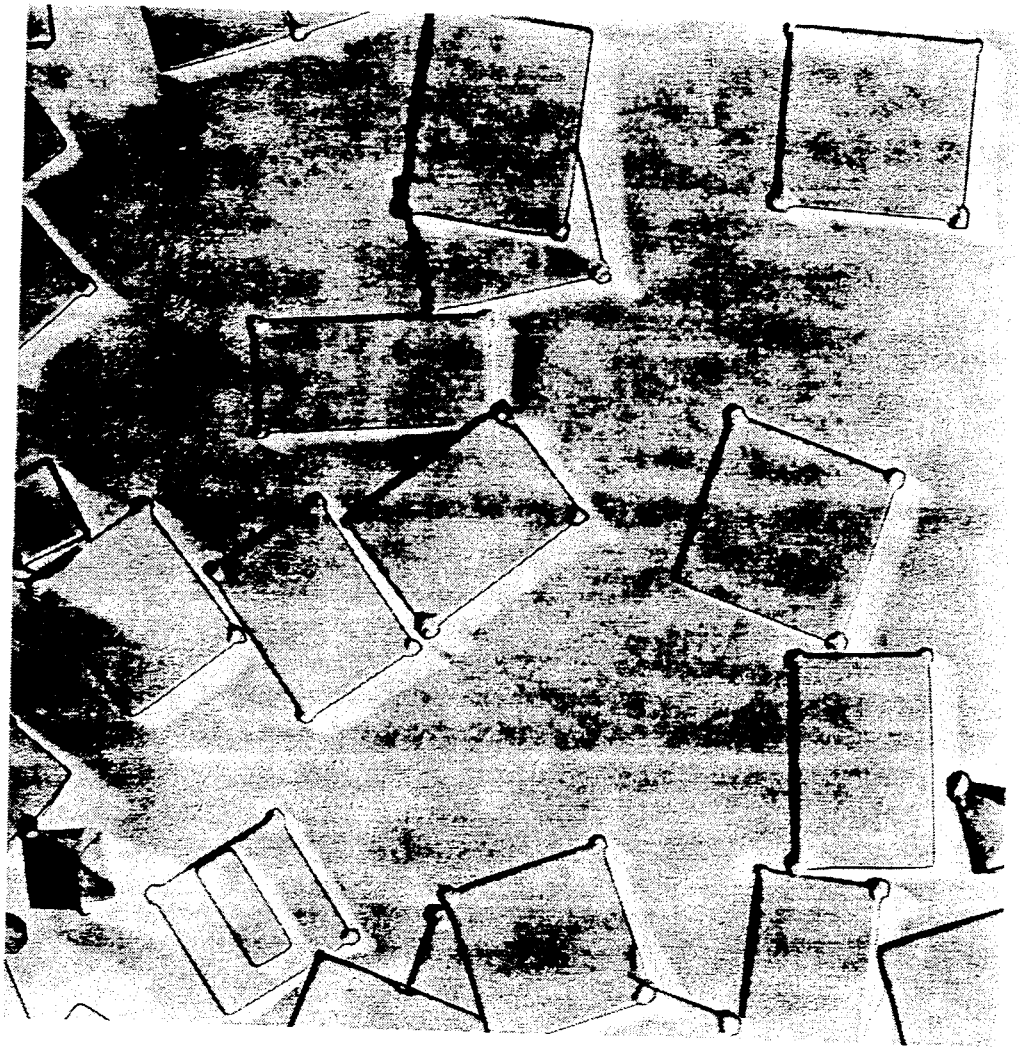
FIGS. 1 to 8 inclusive are photomicrographs of shadowed carbon replicas of emulsion grains.

To 0.025 moles of the epitaxial emulsion was added 0.54 mmole Dye A/Ag mole and 0.53 mmole APMT/Ag mole. The mixture was heated for 15 min at 65° C. The resulting emulsion retained corner epitaxial growths. Analysis by x-ray powder diffraction revealed that the growths were composed of a mixed phase that was 81 mole % AgBr and 19 mole % AgCl. The grains are shown in FIG. 1.

Control Part 2bx

Figure 2:
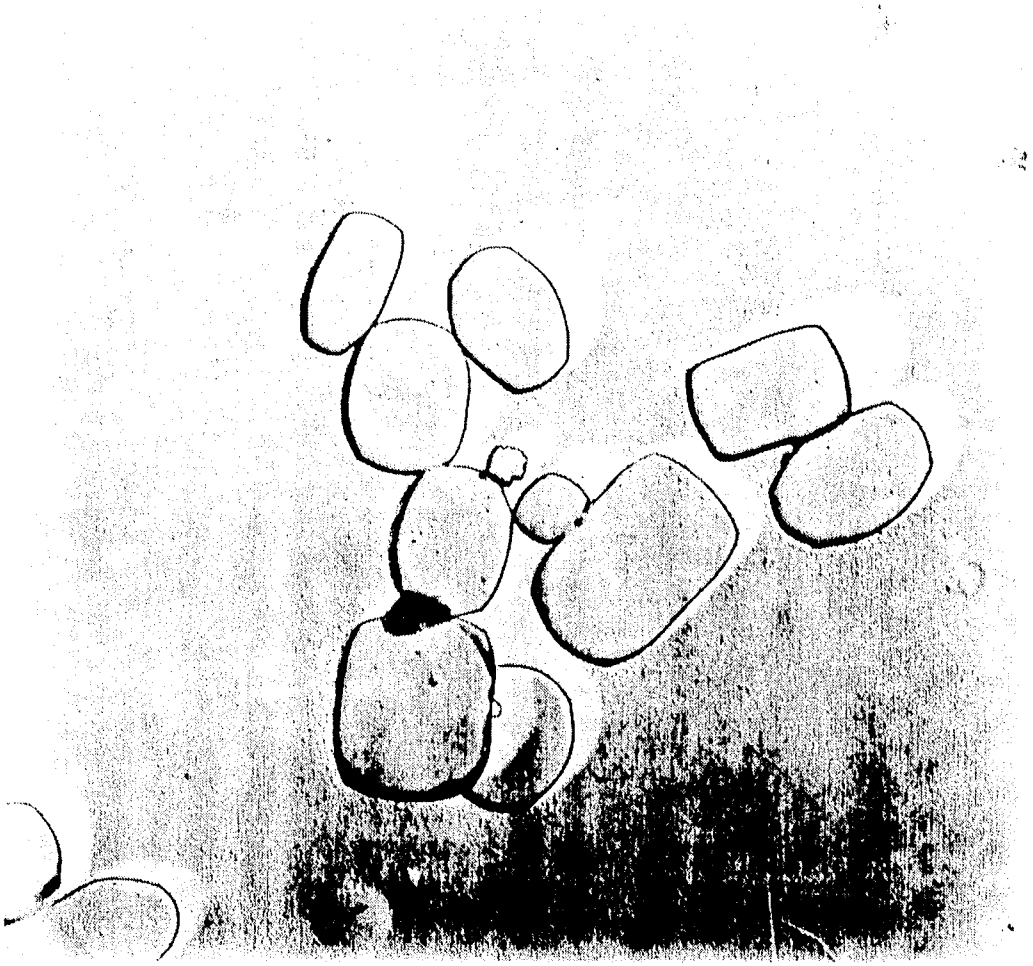

A 0.025 mole portion of the epitaxial emulsion was heated for 15 min at 65° C., cooled to 40° C., and then was added 0.54 mmole Dye A/Ag mole and 0.53 mmole APMT/Ag mole. The resulting emulsion lacked the well-defined corner growths that had been present before the emulsion was heated. Analysis by x-ray powder diffraction showed that the AgBr containing phase contained only 14 mole % AgBr and 86 mole % AgCl. The grains are shown in FIG. 2.

Parts 2ax and 2bx were each mixed with additional gelatin and coated on polyester film support to give 2.24 g silver/$m^2$ and 3.4 g gelatin/$m^2$ making coatings 2AX and 2BX, respectively. Coatings 2AX and 2BX were exposed for 0.1 s to a 600 W, 300° K. tungsten light source through a 0–4.0 density step tablet. The exposed coatings were processed in Kodak Developer DK-50 TM for 3 min at 20° C. The results are given in Table II.

Dye A is anhydro-5-chloro-3,3'-di(3-sulfopropyl)-naphthol[1,2-d]thiazolothiacyanine hydroxide triethylammonium salt.

APMT is 1-(3-acetamidophenyl)-5-mercaptotetrazole sodium salt.

Example 3

Gold Sensitized, Corner Epitaxial Emulsion

This example was made in a similar manner to that of Example 2 except that 1 mL of a 0.88 mM solution of bis(1,4,5-trimethyl-1,2,4-triazolium-3-thiolate) gold (I) tetrafluoroborate was added instead of the sodium thiosulfate solution. The resulting Example Part 3ax and Control Part 3bx were examined by electron microscopy and only Example Part 3ax had well defined growths at the corners of the tabular grains. The results of the coatings are given in Table II.

Example 4

Sulfur Sensitized, Corner Epitaxial Emulsion Made with $Br^-$ and $I^-$

This example was made in a similar manner to that of Example 2 except that instead of adding a solution 0.2M in NaBr, a solution 0.188M in NaBr and 0.012M in NaI was used. The resulting emulsions were examined by electron microscopy and only Example Part 4ax was found to have growths at the corners of the tabular grains. The results of the coatings are given in Table II.

Control Example 5

Epitaxy Grown at 58° C. with Stabilizers

Figure 3:
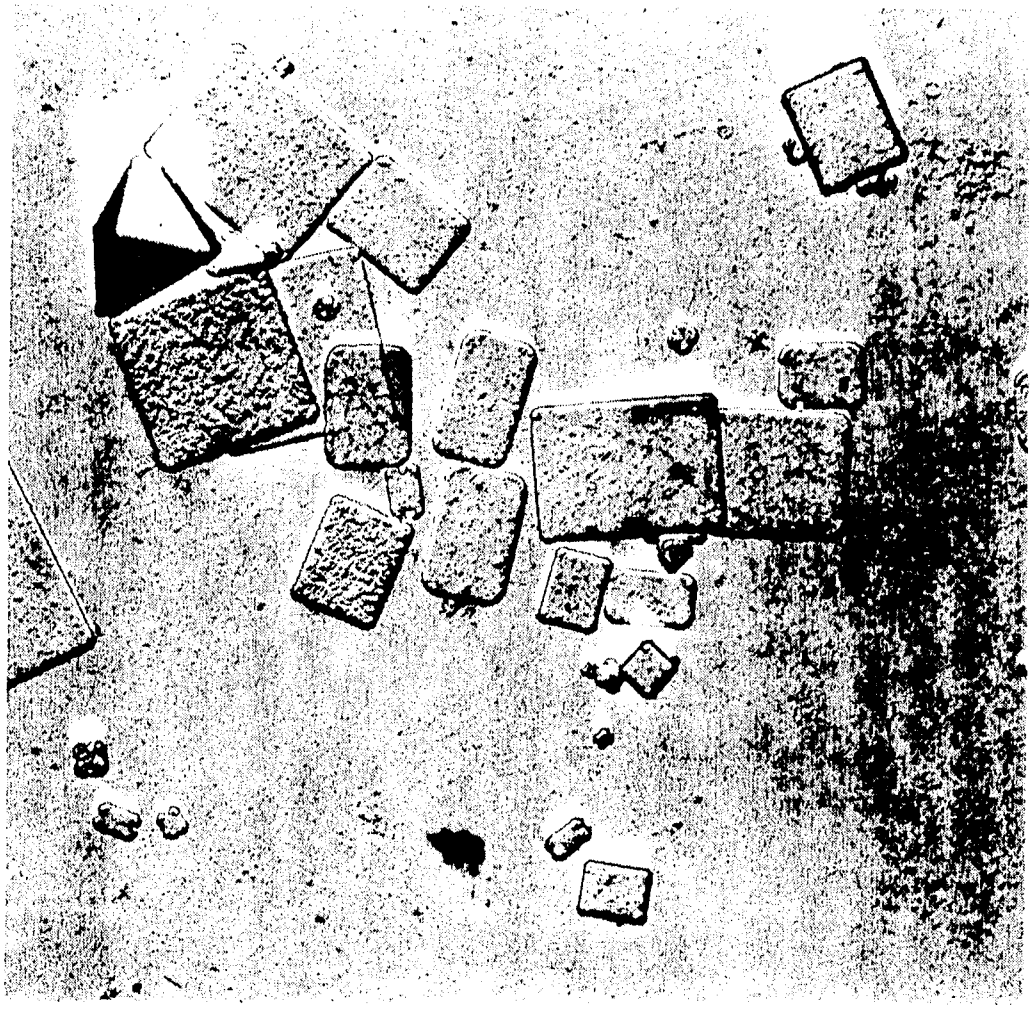

A stirred 50 g portion (0.05M) of Host Emulsion A was adjusted to pH 5.3 with $H_2SO_4$ and pCl of 2.05 with NaCl, then 0.54 mmole Dye A/Ag mole and 0.53 mmole APMT/Ag mole were added. To this emulsion at 58° C. was added 5 mL of a solution of 0.2M NaBr at 0.5 mL/min. Electron photomicrographs revealed that most of the epitaxial growths formed on to the grains' major faces and only a relatively small amount onto the corners, FIG. 3. X-ray energy dispersive spectra of the grains' corners of 5 tabular grains gave a mean composition of only 12 mol % bromide. To 0.025M portion of the resulting emulsion was added 1 mL of a 1.44 mM sodium thiosulfate solution and the mixture was heated for 15 min at 65° C. Additional gelatin was added and the mixture coated on polyester film support to make Control Coating 5×. It had 2.24 g silver per $m^2$ and 3.4 g gelatin per $m^2$. The coating was exposed and processed as described for Example 2. The results are summarized in Table II.

TABLE II

| Coating No. | Type | Corner Epitaxy | $D_{min}$ | Relative Sensitivity |
|---|---|---|---|---|
| 2AX | Example | Yes | 0.07 | 204 |
| 2BX | Control | No | 0.78 | 55 |
| 3AX | Example | Yes | 0.11 | 263 |
| 3BX | Control | No | 0.21 | 229 |
| 4AX | Example | Yes | 0.10 | 288 |
| 4BX | Control | No | 0.91 | 54 |
| 5X | Control | Mostly on faces | 0.03 | 100 |

Example 6

Corner Epitaxy Stabilized with Low Level of Stabilizer

A stirred 50 g portion (0.05M) of Host Emulsion A at 25° C. was adjusted to a pCl of 2.06 with NaCl. Then 10 mL of a solution of 0.2M NaBr was added at 0.5 mL/min to the stirred emulsion at 25° C.

Example Part 6a

Figure 4:
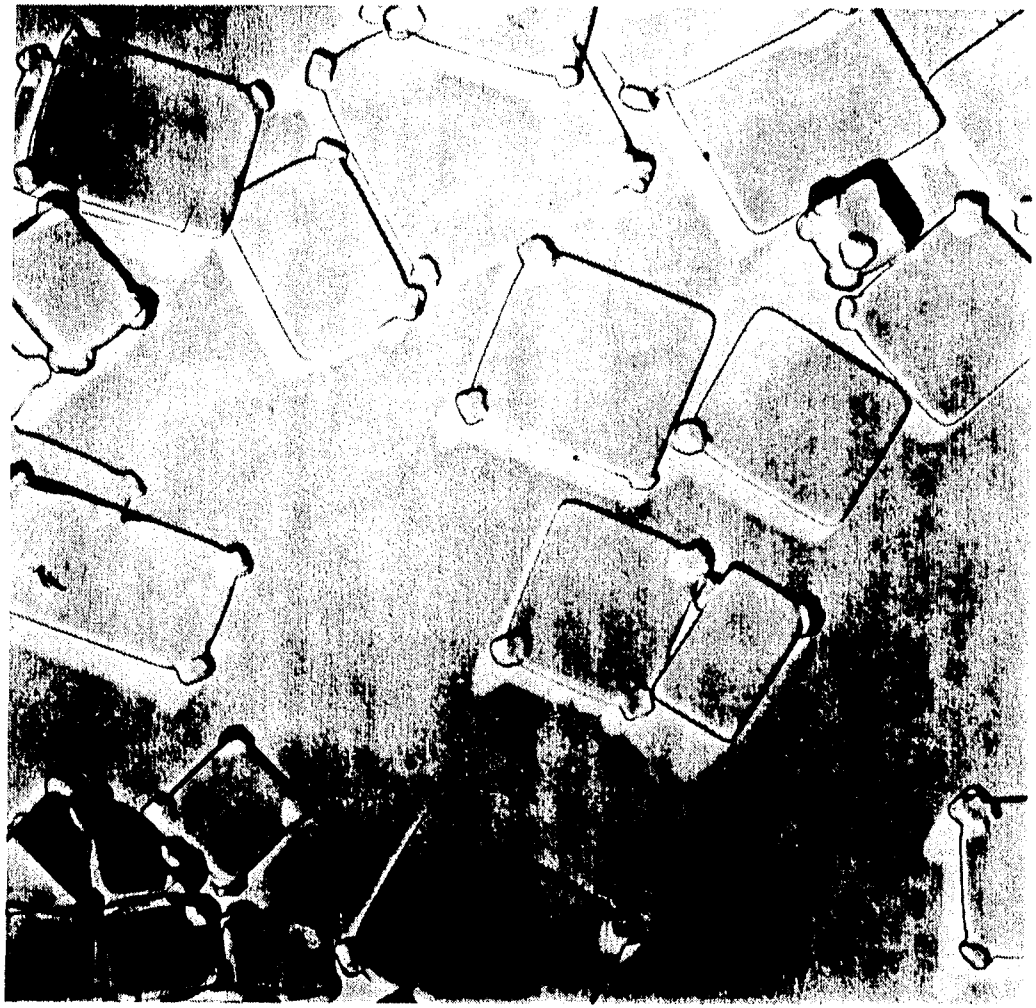

To 10 g of this epitaxial emulsion (8.3 mmole) was added 0.535 mmole APMT/Ag mole; this is 25% of calculated monolayer coverage. The mixture was heated for 15 min at 60° C. Electron photomicrographs showed that epitaxial growths were still at the corners of the tabular grains, FIG. 4.

Control Part 6b

Figure 5:
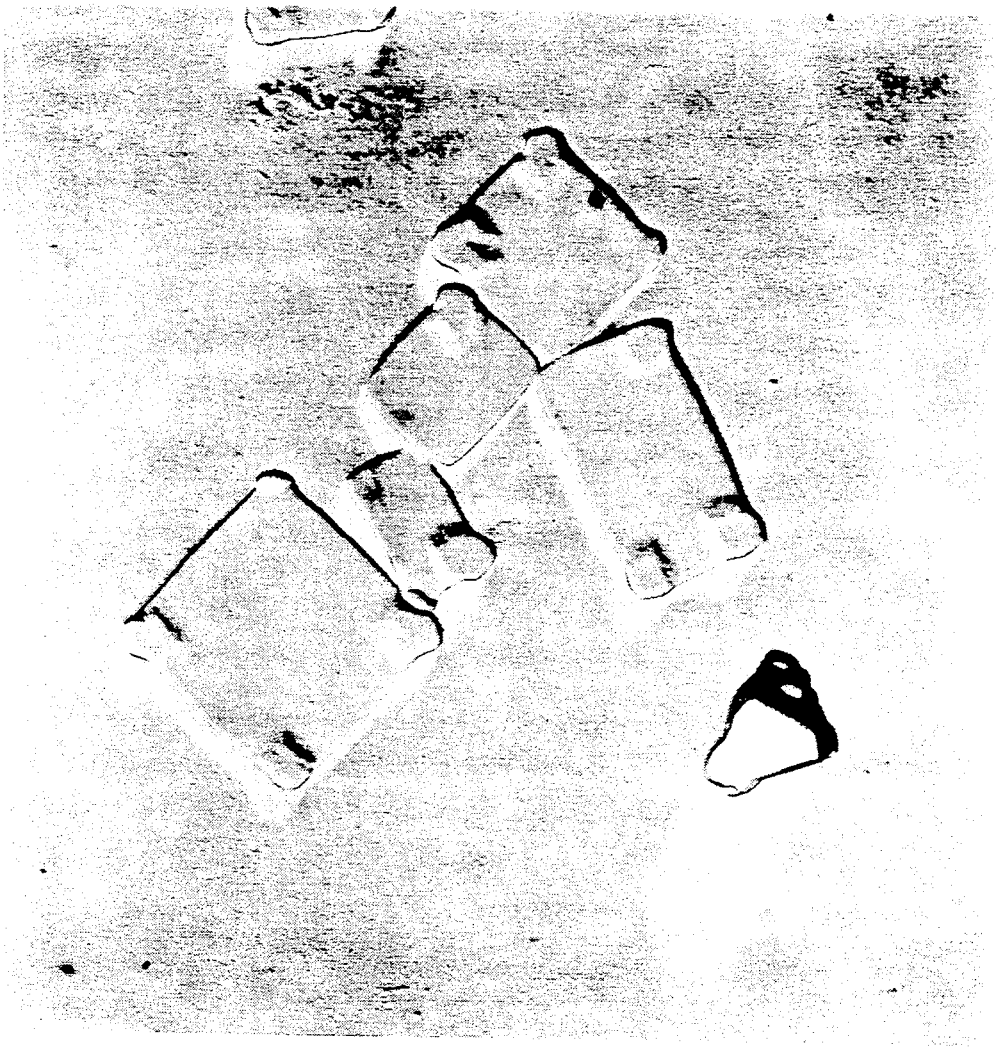

To another 10 g of this epitaxial emulsion was added 0.268 mmole APMT/Ag mole; this is 13% of calculated monolayer coverage. The mixture was heated for 15 min at 60° C. Electron photomicrographs showed that the epitaxial growths were spread out at the corners of the tabular grains, FIG. 5.

These results show that 25% coverage of stabilizer will prevent significant ripening of the corner growths and that 13% will not.

Example 7

Corner Epitaxial Emulsion on Pure Chloride Host

A 0.05 mole portion of Host Emulsion B was diluted to 50 g with distilled water, adjusted to pH 5.3 with $H_2SO_4$, and pCl of 2.06 with NaCl at 25° C. To this mixture at 25° C. was added, with good stirring, 5 mL of a solution of 0.2M NaBr at 0.5 mL/min. The resulting epitaxial emulsion was examined by electron microscopy and found to have growths at the corners of the tabular grains which were absent in the starting host emulsion.

Example Part 7a

Figure 6:
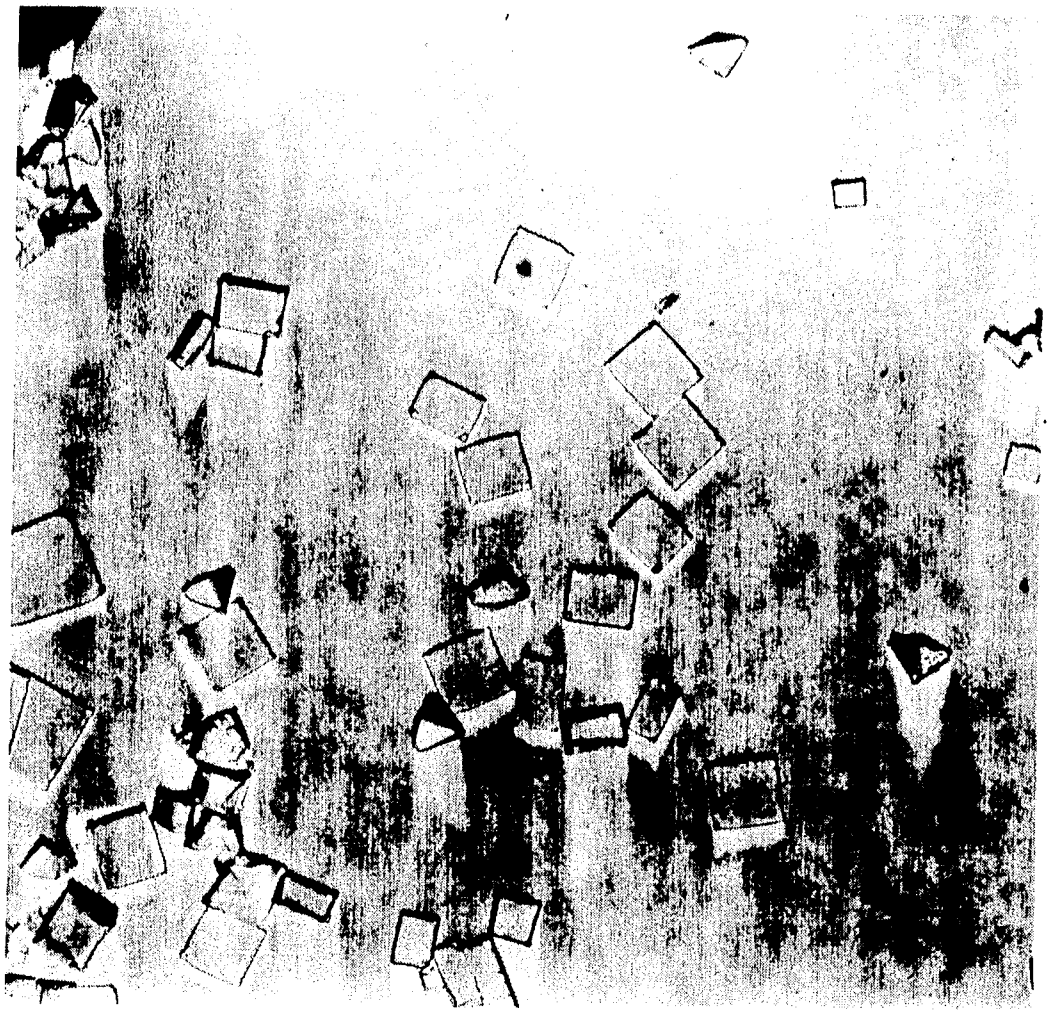

To 0.025 mole of the epitaxial emulsion at 25° C. were added 0.37 mmole/Ag mole of Dye A and 0.37 mmole/Ag mole of APMT. The mixture was heated for 15 min at 65° C. and then examined by electron microscopy, FIG. 6. The grains still had corner epitaxial growths.

Control Part 7b

Figure 7:
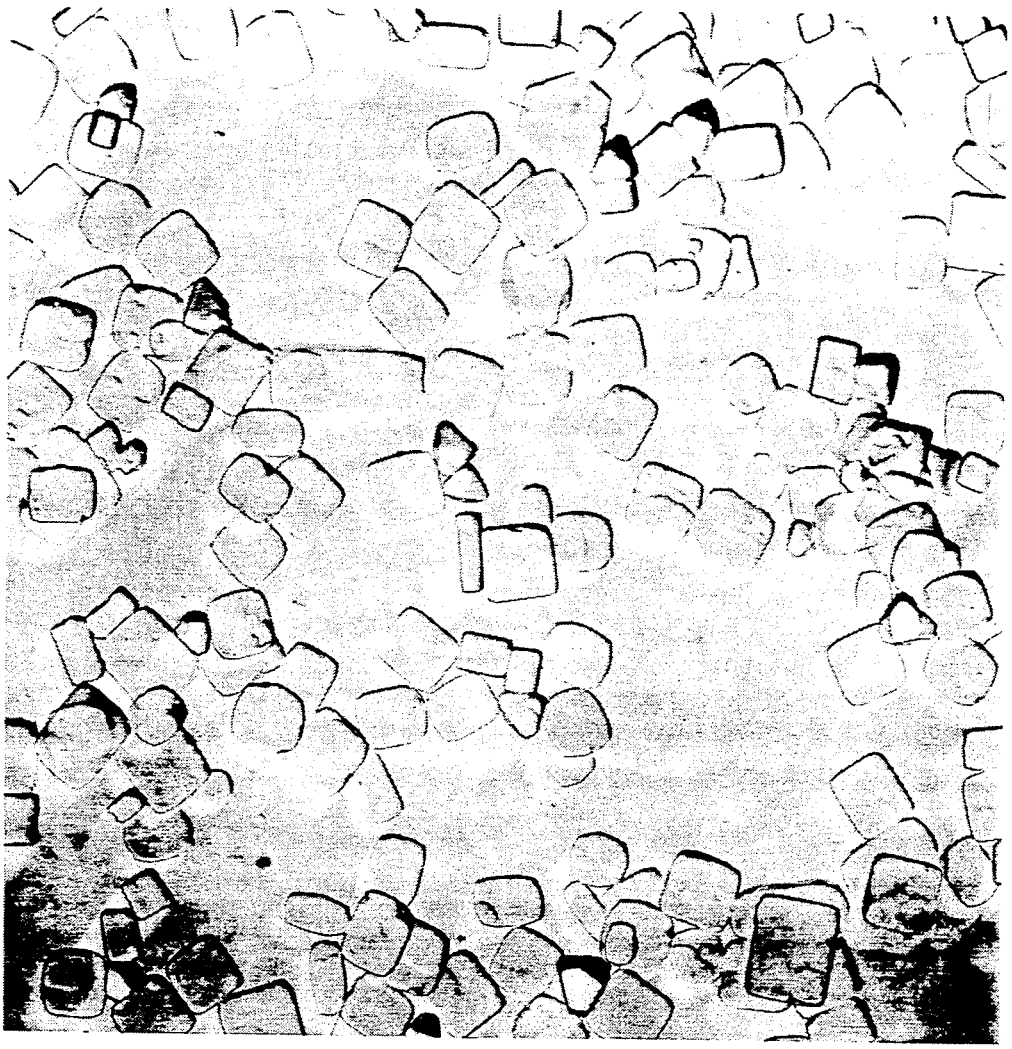

A 0.025 mole portion of the epitaxial emulsion was heated for 15 min at 65° C. and then 0.37 mmole/Ag mole of Dye A and 0.37 mmole/Ag mole of APMT were added. Electron microscopy did not show distinct corner epitaxial growths indicating that they had ripened away, FIG. 7.

Example 8

Green Spectrally Sensitized and S+Au Chemically Sensitized Corner Epitaxial Emulsion A stirred 50 g portion (0.05M) of Host Emulsion A at 25° C. was adjusted to a pCl of 2.06 with NaCl and a pH of 5.3 with $H_2SO_4$. Then 5 ml of a solution of 0.2M NaBr was added at 0.5 ml/min. Then 0.7 mmol per mol Ag of a methanol solution of the green spectral sensitizing dye, anhydro-5-chloro-9-ethyl-5'-phenyl-3'-(3-sulfobutyl)-3-(3-sulfopropyl)oxacarbocyanine hydroxide, triethylammonium salt. After 5 min the temperature was increased to 40° C. and $4.0\times10^{-6}$ mol per Ag mol of a solution of sodium thiosulfate and $2.6\times10^{-6}$ mol per Ag mol of a solution of potassium tetrachloroaurate were added. The mixture was heated for 15 min at 60° C. to make Example Emulsion 8ax. Electron photomicrographs showed that the tabular grains had well defined epitaxial corner deposits.

A control emulsion was also prepared. To a stirred 50 g portion (0.05M) of Host Emulsion A at 60° C. was added 0.5 ml of a solution of 2.0M NaBr requiring 1 sec. The emulsion was cooled to 40° C. and 0.7 mmol per Ag mol of the same green spectral sensitizing dye used above was added and $4.0\times10^{-6}$ mol per Ag mol of a solution of sodium thiosulfate and $2.6\times10^{-6}$ mol per Ag mol of a solution of potassium tetrachloroaurate were added. The mixture was heated for 15 min at 60° C. to make Control Emulsion 8bx. Electron photomicrographs showed that the tabular grains lacked defined epitaxial corner deposits.

Emulsions 8ax and 8bx were mixed with additional gelatin and a small amount of surfactant then coated on polyester film support to give Example Coating 8AX and Control Coating 8BX. They were 2.24 g Ag per $m^2$ and 3.4 g gelatin per $m^2$. The coatings were exposed to a tungsten light source for 0.02 sec through a yellow Wratten TM WR 9 filter and a 0–4.0 density step tablet. The exposed coatings were processed in Kodak Developer DK-50 for 1 min at 20° C.

The results are given in Table III. The photographic speed of Example Coating 8AX was significantly faster than that of Control Coating 8BX.

Control Example 9

One Mole Percent Bromide Added Rapidly and at 52.5° C.

Epitaxial deposition was undertaken similarly to that of Emulsion G4 of Example 7 of Ogawa U.S. Pat. No. 4,791,053. The host emulsion was an AgCl {100} type tabular grain emulsion, and the procedure was scaled-down to use 0.05M of host emulsion.

To 207 ml of a 52.5° C. solution containing 0.05 mol of Host Emulsion A was added 0.7 mmol per Ag mol of a methanol solution of anhydro-5,5'-diphenyl-9-ethyl-3,3'-di(3-sulfoethyl)oxacarbocyanine hydroxide, pyridinium salt. After 7 min, a solution containing 0.06 g potassium bromide in 1.0 distilled water was added in 2 sec., and the emulsion was stirred for an additional 10 min. X-ray energy dispersive spectra of the grains' corners of 5 tabular grains gave a mean composition of only 5 mol % bromide. Thereafter, the thus obtained emulsion was washed with water and concentrated. The resulting emulsion was chemically sensitized by adding solutions of $4.0\times10^{-6}$ mol per Ag mol of sodium thiosulfate and $2.6\times10^{-6}$ mol per Ag mol of potassium tetrachloroaurate and heated 15 min at 60° C. to make Control Emulsion 9x. Carbon replica electron photomicrographs did not show any corner growths on the tabular grains. This emulsion was coated, exposed and processed as those of Example 8. The results are given in Table III.

TABLE III

| Coating No. | Type | Corner Epitaxy | $D_{min}$ | $D_{max}$ | Relative Sensitivity |
|---|---|---|---|---|---|
| 8AX | Example | Yes | 0.43 | 2.05 | 389 |
| 8BX | Control | No | 0.23 | 1.82 | 100 |
| 9X | Control | No | 0.85 | 2.23 | 138 |

The invention has been described in detail with particular reference to preferred embodiments thereof, but it will be understood that variations and modifications can be effected within the spirit and scope of the invention.

What is claimed is:

1. A radiation sensitive emulsion containing a silver halide grain population comprised of at least 50 mole percent chloride, based on total silver forming the grain population, in which greater than 30 percent of the grain population projected area is accounted for by tabular grains having an average aspect ratio of greater than 8 and a mean thickness of less than 0.3 μm, wherein, the tabular grains have parallel major faces lying in {100} crystallographic planes and chemically sensitized silver halide epitaxial deposits containing less than 75 percent of the chloride ion concentration of the tabular grains and accounting for less than 20 mole percent of total silver are located at one or more of the corners of the tabular grains.

2. A radiation sensitive emulsion according to claim 1 wherein greater than 50 percent of the total grain projected area is accounted for by tabular grains having {100} major faces and a thickness of less than 0.3 μm.

3. A radiation sensitive emulsion according to claim 2 wherein greater than 50 percent of the total grain projected area is accounted for by tabular grains having {100} major faces and a thickness of less than 0.2 μm.

4. A radiation sensitive emulsion according to claim 1 wherein of the tabular grains bounded by {100} major faces a portion accounting for 50 percent of total grain projected area selected on the criteria of adjacent major face edge ratios of less than 10 and thicknesses of less than 0.3 μm and having higher aspect ratios than any remaining tabular grains satisfying these criteria (1) have an average aspect ratio of greater than 8 and (2) internally at their nucleation site contain iodide and at least 50 mole percent chloride.

5. A radiation sensitive emulsion according to claim 4 wherein the selected portion of the tabular grains have an average aspect ratio of greater than 12.

6. A radiation sensitive emulsion according to claim 4 wherein the selected portion of the tabular grains have adjacent major face edge ratios of less than 5.

7. A radiation sensitive emulsion according to claim 1 wherein the tabular grains contain at least 90 mole percent chloride.

8. A radiation sensitive emulsion according to claim 1 wherein the silver halide epitaxial deposits account for from 0.05 to 10 mole percent of total silver.

9. A radiation sensitive emulsion according to claim 8 wherein the silver halide epitaxial deposits account for from 0.3 to 5 mole percent of total silver.

10. A radiation sensitive emulsion according to claim 1 wherein the silver halide epitaxial deposits contain less than 50 percent of the chloride ion concentration of the host tabular grains.

11. A radiation sensitive emulsion according to claim 10 wherein the silver halide epitaxial deposits contain less than 30 percent of the chloride ion concentration of the host tabular grains.

12. A process of preparing an emulsion for photographic use comprising forming an emulsion containing a silver halide grain population comprised of at least 50 mole percent chloride, based on total silver forming the grain population, in which greater than 30 percent of the grain population projected area is accounted for by tabular grains having an average aspect ratio of greater than 8 and a means thickness of less than 0.3 μm, epitaxially depositing silver halide onto the tabular grains, and chemically sensitizing the emulsion, wherein, the tabular grains are formed with parallel major faces lying in {100} crystallographic planes, the silver halide epitaxial deposit is selected to contain less than 50 percent of the chloride ion concentration of the tabular grains and is deposited at a rate of less than $5\times10^{-17}$ mol per corner-minute at a temperature of less than 45° C. at one or more corners of the tabular grains, a photographically useful compound is adsorbed to the surfaces of the silver halide epitaxial deposits, and the emulsion is chemically digested to increase its photographic speed while the adsorbed photographically useful compound acts as a morphological stabilizer and restrains chloride ion invasion of the epitaxial deposits at the corners of the tabular grains during chemical digestion.

13. A process according to claim 12 wherein the photographically useful compound contains a divalent sulfur or selenium atom.

14. A process according to claim 12 wherein the photographically useful compound contains a cyanine dye basic heterocyclic nucleus.

15. A process according to claim 12 wherein the photographically useful compound is a cyanine or merocyanine dye.

16. A process according to claim 12 wherein the photographically useful compound is an antifoggant or stabilizer.

17. A process according to claim 12 wherein the photographically useful compound is present in a concentration sufficient to provide at least 20 percent of monomolecular coverage of the tabular grain surfaces.

18. A process of preparing an emulsion for photographic use comprising forming an emulsion containing a silver halide grain population comprised of at least 90 mole percent chloride, based on total silver forming the grain population, in which greater than 50 percent of the grain population projected area is accounted for by tabular grains having a means thickness of less than 0.2 μm, epitaxially depositing silver halide onto the tabular grains, and chemically sensitizing the emulsion, wherein, the tabular grains are formed with parallel major faces lying in {100} crystallographic planes and have an average aspect ratio of at least 12, the silver halide epitaxial deposit is selected to contain less than 30 percent of the chloride ion concentration of the tabular grains and is deposited at a rate of less than $5\times10^{-17}$ mol per corner-minute at a temperature of less than 45° C. at one or more corners of the tabular grains, a photographically useful spectral sensitizing dye, antifoggant or stabilizer containing a divalent sulfur or selenium atom is adsorbed to the surfaces of the silver halide epitaxial deposits, and the emulsion is chemically digested in the presence of at least one of a gold and middle chalcogen sensitizer to increase its photographic speed while the adsorbed photographically useful compound acts as a morphological stabilizer and restrains chloride ion invasion of the epitaxial deposits at the corners of the tabular grains during chemical digestion.

* * * * *